United States Patent [19]

Tolliver et al.

[11] 3,964,938

[45] June 22, 1976

[54] METHOD AND APPARATUS FOR FORMING HIGH TENSILE STEEL FROM LOW AND MEDIUM CARBON STEEL

[75] Inventors: Wilbur E. Tolliver, Holland; Daniel J. Borodin, Detroit, both of Mich.

[73] Assignee: New York Wire Mills Corporation, Tonowanda, N.Y.

[22] Filed: Jan. 20, 1975

[21] Appl. No.: 542,341

[52] U.S. Cl. ..... 148/12 B; 72/202; 72/205; 72/378; 148/12.4; 266/121

[51] Int. Cl.[2] ..... C21D 9/52; C21D 11/00

[58] Field of Search ..... 148/128, 12 B, 11.5 R, 148/11.5 A, 11.5 F, 11.5 C, 11.5 N, 12.4; 72/205, 201, 202, 378; 266/4 R

[56] References Cited

UNITED STATES PATENTS

| | | | |
|---|---|---|---|
| 3,196,052 | 7/1965 | Hann | 148/2 B |
| 3,229,492 | 1/1966 | Tufts | 148/12 B |
| 3,230,118 | 1/1966 | Tufts | 148/12 B |
| 3,264,143 | 8/1966 | Turner, Jr. | 148/11.5 A |
| 3,312,576 | 4/1967 | Palik | 148/11.5 A |
| 3,699,797 | 10/1972 | Tournoy | 148/12 B |

*Primary Examiner*—W. Stallard

*Attorney, Agent, or Firm*—Price, Heneveld, Huizenga & Cooper

[57] ABSTRACT

The specification discloses a completely automated method and apparatus for producing high tensile steel, of a controlled, predetermined U.T.S. and cross sectional area, from low and medium carbon steel by subjecting the steel to substantial elongation while simultaneously substantially heating and immediately thereafter rapidly quenching the steel, and while continually moving the steel relative to the heating and quenching means employed. The steel is heated to a temperature above its austenite conversion temperature. Greater elongation produces greater ultimate tensile strength, as much as more than twice as great as the starting ultimate tensile strength, and elongations approaching 200 percent have been effected.

75 Claims, 30 Drawing Figures

SECTION A.

SECTION B.

(TOP FRAME)
(MIDDLE FRAME)
(BOTTOM FRAME)
T°
T
S
C
C
W
8
W
$S_1$
$S_N \times f\left(\frac{N_2}{N_1}\right) = \left[(P_1 L) \times f_1\left(\frac{N_2}{N_1}\right)\right]$
$S_N = P_1 L$
$S_2 = \left[(P_2 L) \times f\left(\frac{N_2}{N_1}\right)\right]$
$S_3$
$W_1$
$W_2$
$W_3$
10
12
$N_2'$
92
910
920
921
922
930
931
HEAT ZONE

METHOD AND APPARATUS FOR FORMING HIGH TENSILE STEEL FROM LOW AND MEDIUM CARBON STEEL

BACKGROUND OF THE INVENTION

The present invention relates to a revolutionary method and apparatus for producing high tensile steel from low and medium carbon steel.

Steel of a high tensile strength is desirable because one can use less steel in a given application in order to achieve a desired level of strength. One known way of increasing tensile strength is through heat treating the steel, i.e. by elevating the steel to a high temperature and by subsequently quenching.

One limitation on heat treating processes for increasing tensile strength is the carbon content of the steel. A high carbon steel, usually considered to be a steel having greater than 0.60 percent carbon, can through rapid quencing be given tensile strength in the range of 150,000 to 200,000 psi, perhaps even more. Medium carbon steels, generally accepted to be steels having 0.30 percent to 0.60 percent carbon, can usually be heat treated to a tensile strength in the range of 100,000 to 150,000 psi. Low carbon steels, those having a carbon content up to 0.30 percent, usually can be heat treated to tensile strengths in the range of 75,000 to 100,000 psi.

Unfortunately, high carbon steel is the most difficult steel to weld. As a result, low carbon steels are more generally used in structural construction applications since they facilitate fabrication by welding. Since the more weldable steels have lower tensile strengths, more steel must be used to give a particular product its desired strength.

William H. Mc Farland has discovered a method of providing a limited variety of high tensile, low carbon steels by first cold rolling steel sheet and then carefully heating the resulting steel to its austenitic range and then rapidly quenching it. U.S. Pat. No. 3,378,360 to William H. McFarland, entitled "MARTENSITIC STEEL", issuing Apr. 16, 1968 on an application filed Sept. 23, 1964. Unfortunately, the resulting martensitic steel is available commercially only in sheets of very thin gauges i.e. 0.007 to 0.035 inches. The McFarland patent indicates that the sheets can be as thick as 0.100 inches, but even this is much too thin for many applications.

Also for many applications, sheet steel is not usable and in many other applications, thicker steel is required. For as long as man has worked with steel, there has been a need for a method and apparatus for producing a wide variety of sizes and shapes of high tensile, low carbon steel.

SUMMARY OF THE INVENTION

The present invention comprises a revolutionary method and apparatus involving the elongation of steel while simultaneously rapidly heating it to a temperature above its austenite conversion temperature and immediately thereafter rapidly quenching it. The steel is continuously moved through spaced sets of drive means operating at different speeds to create an elongating force on the steel. Between the two drive means, a high temperature heating means is provided to rapidly heat the steel to a temperature above its austenite conversion temperature and a rapid quenching means is provided immediately thereadjacent. Both the UTS and the desired cross sectional area for the steel can be predicted and controlled by the highly flexible and automated process and apparatus of the present invention.

The percent of elongation, or reduction of thickness or diameter of the steel, is an important factor in determining the ultimate tensile strength which will be obtained by this process. Substantial elongations are effected, e.g. approaching 200 percent. Other factors include the ultimate temperature achieved, and surface temperatures as high as 2,050° F. have been recorded. A temperature of at least about 2000° F. is preferable. The velocity of the steel through the drive means is a factor and, as long as the heat source is hot enough and the quenching means are cool enough, a more rapid velocity results in a greater ultimate tensile strength, perhaps because the quenching is more rapid, and it is theorized, perhaps because the rate of deformation of the steel is higher.

The results of this process are highly surprizing and are totally unpredicted by the prior art. For years, prior artisans have heated and simultaneously stretched steel wire at temperatures below the austenite conversion temperature for purposes of achieving elongations typically no greater than 5 to 10 percent in order to "destress" the steel wire for subsequent use as prestressing wire. Yet this use has never led to a recognition of the exciting results which can be achieved through use of the method and apparatus of the present invention.

These results include the production of a very high tensile strength steel out of a low carbon steel. This result can be effected on thicker steels, as for example quarter inch diameter wire, and, it is believed, on thicker steels and on other different types of steel, as for example, sheet steel, bar stock steel and strip steel.

The tremendous elongations achieved provide yet another advantage in that a mill operator can proceed directly from thicker "green stock" to a final product of a given diameter or thickness without using the multiplicity of discs (or rollers in the case of sheet or strip steel) required in conventional operations. The process of the present invention can be effectively incorporated in many existing processes to effect complete automation thereof. Finally, because low carbon steel is the least expensive steel which can be purchased, the present invention offers a means for achieving extremely strong steel at a very economical price.

These and other features, objects and advantages of the present invention will be more fully understood and appreciated by reference to the written specification and appended drawings.

DESCRIPTION OF THE PREFERRED EMBODIMENT

I. Introduction

The embodiments of the present invention which are disclosed herein are for treating wire or rod, although it appears feasible to utilize the present invention on sheet, strip and bar stock as well.

Figure 1:
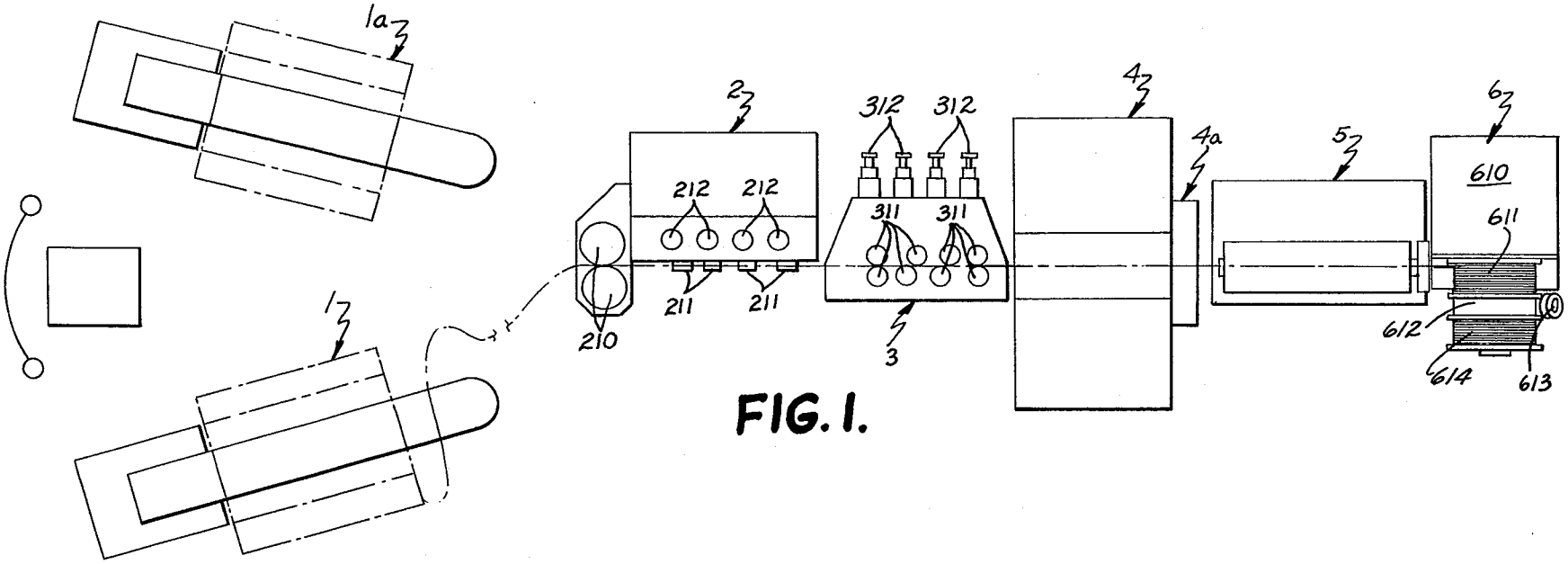
FIG. 1 is a top plan view of section A of the apparatus in which wire is pretreated and prereduced.
Figure 2:
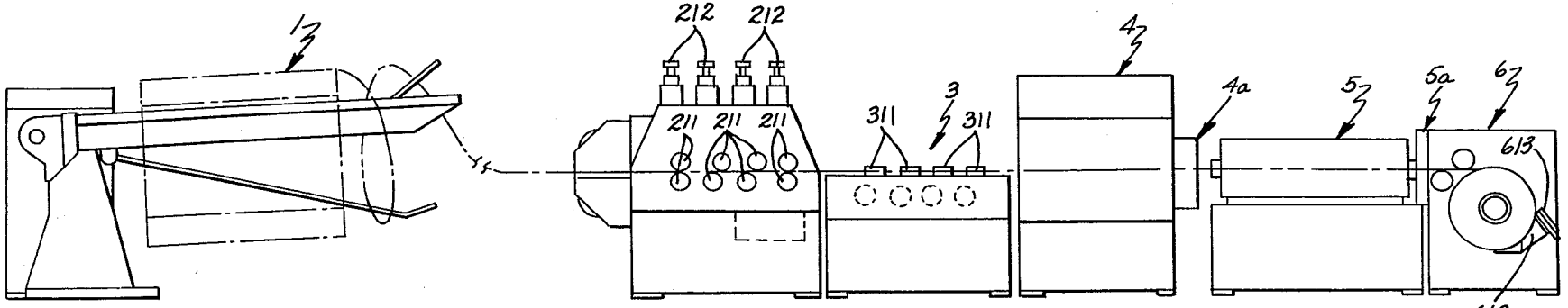
FIG. 2 is a front elevational view of section A.
Figure 4:
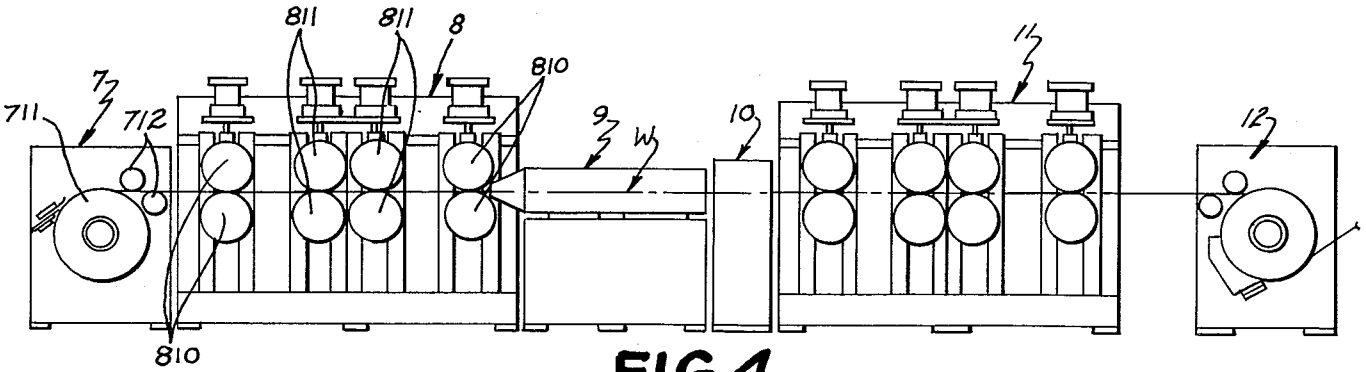
FIG. 4 is a front elevational view of the section B apparatus.
Figure 5:
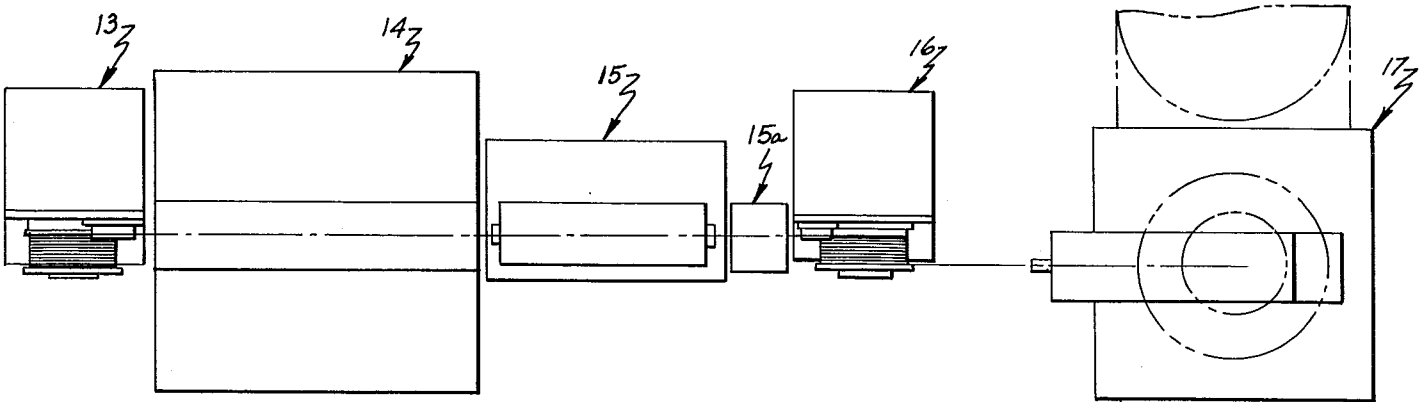
FIG. 5 is a top plan view of section C of the apparatus at which the wire is finally descaled, undergoes a final adjusting reduction and is coiled for later shipment.
Figure 6:
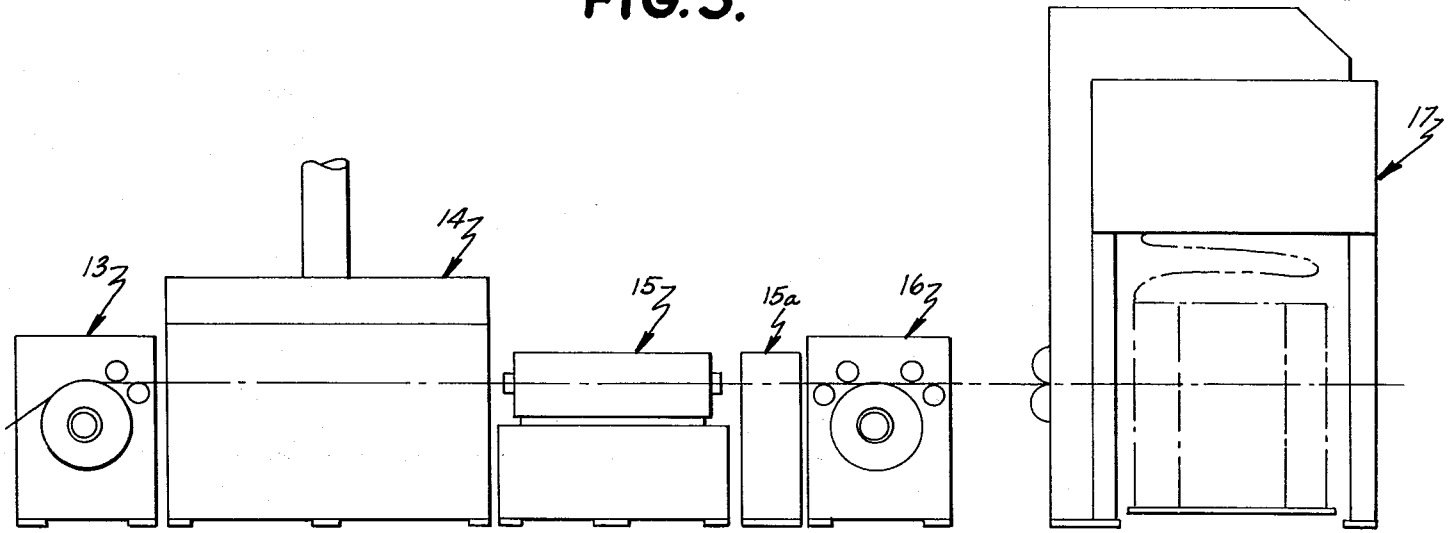
FIG. 6 is a front elevational view of section C.

The completely automated wire-treating system of the preferred embodiment can be conveniently divided into three sections as follows:

Section A for pretreating and prereducing the wire diameter (FIGS. 1 and 2);

Section B for primarily treating the wire, to elongate it and give it its surprisingly high ultimate tensile strength (FIGS. 3 and 4); and Section C for post-treating, precision sizing and coiling the resulting wire (FIGS. 5 and 6).

Figure 3:
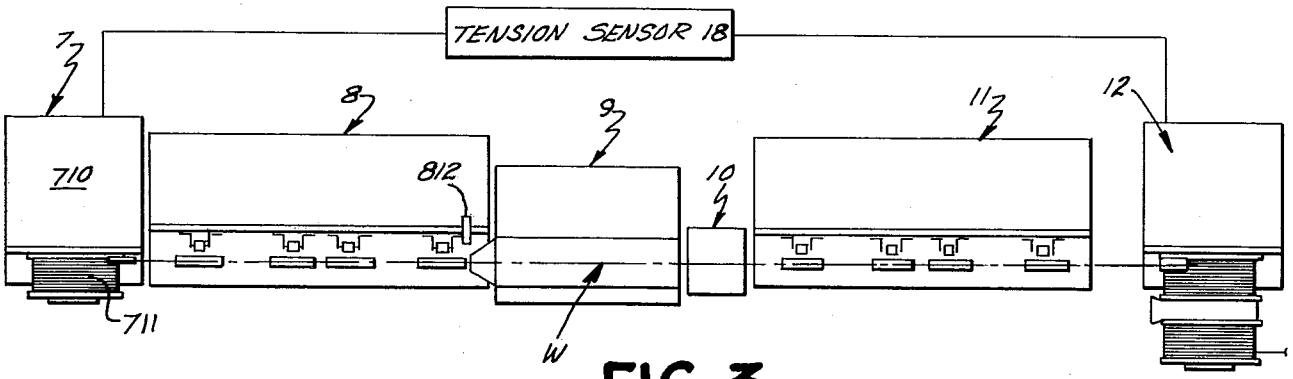
FIG. 3 is a top, plan view of section B of the apparatus at which the wire is primarily processed through the opposing force applying drives, high heat and quench means.

Section B (FIGS. 3 and 4) includes the high-tensioning drive means, namely a drag drive capstan 7 and an elongating drive 12, the high temperature heating means 8 and rapid quenching means 9 all referred to in the "Summary of the Invention" above. Also included is gauge 10 which gauges the wire as it leaves the rapid quenching means 9 to provide a system operation control signal. An optional tempering heater 11 is also shown in FIGS. 3 and 4. As the wire W passes through section B of the apparatus, it is substantially reduced and elongated, for example, to an excess of 100 percent elongation, and it is given its exceptional and surprisingly high ultimate tensile strength.

Section A (FIGS. 1 and 2) includes wire load and payoff stands 1 and 1a (used alternatively to ensure a continuous operation), a set of vertical wire-straightening rolls 2, a set of horizontal straightening rolls 3, a mechanical descaler 4, a wire gauge 4*a*, providing a means for ensuring that the wire being fed into the system is of the diameter which the system operator believes is being fed into the system, a die means, referred to herein as a self-compensating die 5, a die gauge 5*a* for indicating the wire diameter after it leaves self-compensating die 5, and a drive capstan 6 for self-compensating die 5. The purpose of self-compensating die 5 is to take irregularities out of the cross section of green rod and to make it possible to pre-reduce the wire before it is fed into section B so that one, or at most only a few, green rod or wire sizes have to be inventoried. The wire processor will, of course, want to finish his operation with a wire of a particular predetermined diameter. Also, he will want to know that the wire has a particular ultimate tensile strength. As noted in the "summary of the Invention", the ultimate tensile strength is a function of the reduction ratio, or percent elongation, of the wire as it is processed in section B. Since the final wire diameter is predetermined and since the reduction ratio must be predetermined in order to give a proper tensile strength, the initial diameter of the wire as it goes into section B must be predetermined. In order to achieve this without having to maintain a large inventory of different sized green wires, the prereduction die, i.e. self-compensating die 5, is provided ahead of section B.

Figure 7:
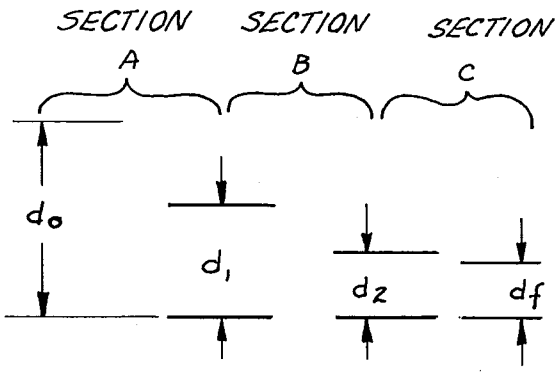
FIG. 7 is a schematic view showing the various reductions in diameter through which the wire goes as it is processed through sections A, B, and C.

Section C (FIGS. 5 and 6) includes a feeder drive capstan 13, a final descaler 14 for removing any scale incurred in processing at section B, a final die means, also a self-compensating die 15, a gauge 15*a* for measuring wire diameter as it leaves the final self-compensating die 15, a drive capstan 16 for pulling wire through self-compensating die 15, and a wire coiling and collecting stand 17. The final self-compensating die 15 is set in accordance with the expected average deviations in processing section B. The final diameter is actually determined, therefore, by final self-compensating die 15. The wire as it leaves processing section B is actually just slightly larger than the finally desired diameter and the extent to which it is larger depends on the degree of error in average diameter which is achieved in processing section B. This relationship between diameters at the various sections is illustrated in FIG. 7. In section A, self-compensating die 5 reduces the wire from an initial diameter $d_0$ to a first diameter $d_1$. At section B, the wire is processed from a diameter $d_1$ to a diameter $d_2$. In the final section, section C, the wire is reduced by self-compensating die 15 from a diameter of $d_2$ to a diameter of $d_f$, the final diameter and the diameter which the processor desires his wire to have upon completion of all operations.

II. Wire Drives for All Sections

Figure 8:
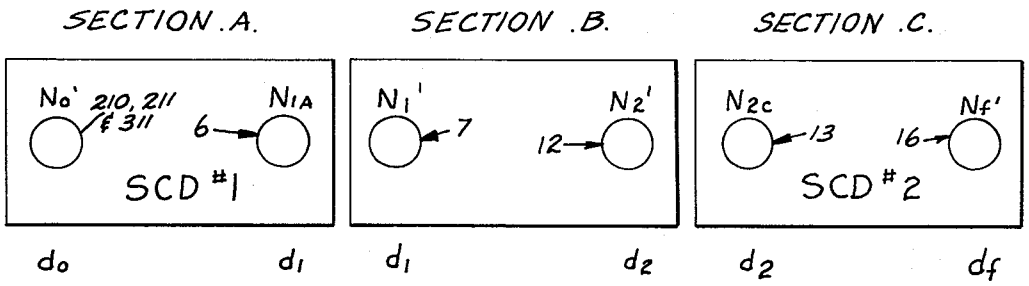
FIG. 8 is a schematic view illustrating the drive rates for the various drive rollers and drive capstans utilized in the apparatus.

The wire drives for processing section B (FIGS. 3 and 4), i.e., drive capstans 7 and 12, are controlled primarily while the drives in sections A and C operate at rates determined by the rates of drive capstans 7 and 12. Referring to FIG. 8, it can be seen that as the wire travels from drive capstan 7 to drive capstan 12 of section B, it reduces in diameter from $d_1$ to $d_2$. Drive capstan 12 is accordingly driven at a substantially faster rate $N_2$ than the rate $N_1$ at which drive capstan 7 is driven. The ratio of $N_2$ to $N_1$ is a function of the amount of diameter reduction which must be achieved in section B. Since the volume of wire passing over drive capstan 7 for any interval of time must equal the volume of wire passing over drive capstan 12 for the same interval of time it is apparent that $$\frac{N_1 \pi d_1^2}{4} \text{ must equal } \frac{N_2 \pi d_2^2}{4}.$$

In other words, $$\frac{N_1}{N_2} = \frac{d_2^2}{d_1^2}.$$

A control system to be discussed hereinafter provides a means for controlling the relative rates of rotation of capstans 7 and 12.

It is apparent that drive capstan 6 adjacent drive capstan 7 should also operate at the same rate of rotation $N_1$ as drive capstan 7, since no wire reduction takes place between them. However, room is provided for some margin over error or play by reason of the fact that drive capstan 6 is of the accumulator type drive capstan (FIGS. 1 and 2). Such accumulator drive capstans are conventional. Referring to FIGS. 1 and 2, it can be seen that drive capstan 6 includes a motor and transmission means 610, an inner reel 611 which rotates in a clockwise direction, and an outer reel 614 which rotates in a counterclockwise direction, to take wire off of inner reel 611 over an idler 613 which is mounted on an accumulator rotor 612. Inner reel 611 is driven by motor and transmission 610. Accumulator rotor 612 is free floating, but is biased toward clockwise movement with inner reel 611. Outer reel 614 is free wheeling and is rotated by means of wire being drawn off of reel 614 by drive capstan 7. If wire is being drawn off outer reel 614 more slowly that it is being wound onto inner reel 611, accumulator rotor 612 will tend to rotate in a clockwise direction thereby causing wire to build up on inner reel 611. If wire is being removed from outer reel 614 at a faster rate than it is being wound onto driven inner reel 611, accumulator rotor 612 will tend to move in a counterclockwise direction, thereby paying more wire off of inner reel 611 which has previously been built up thereon. Movement of rotor 612 is sensed to provide a system control signal which is helpful in the drive control means described hereinafter.

Accordingly, it is apparent that the rate of rotation of the inner reel 611 of drive capstan 6 may actually be somewhat different than $N_1$. Accordingly, the rate of rotation of drive capstan 6 has been given the symbol $N_{1A}$, the sub A being utilized since drive capstan 6 is located in section A. In a similar manner, drive capstan 13 in section C should theoretically rotate at the same rate of speed as drive capstan 12, i.e., $N_2$. To allow for error or play between the two, drive capstan 12 is also an accumulator drive capstan of a construction identical to that of accumulator drive capstan 6. Drive capstan 13 may rotate at a slightly different rate of rotation $N_{2C}$ than does drive capstan 12, the sub C being used since drive capstan 13 is located in section C. Both drive capstan 13 and drive capstan 7 are of a conventional type having, with reference to drive capstan 7 in FIGS. 3 and 4, a drive motor and transmission assembly 710, a reel 711, and perhaps conventional idlers 712.

Referring to section A of FIG. 8, it is apparent that the rate of rotation $N_{1A}$ of drive capstan 6 at the end of section A must be greater than the rate of rotation of the various drive rollers of straightening apparatus 2 and 3 since the wire undergoes a substantial reduction in diameter from $d_0$ to $d_1$ as it passes through self-compensating die 5. The wire straightening apparatuses 2 and 3 are conventional straightening devices. The vertical straightening device 2 includes driven feed rollers 210 and driven straightening rollers 211 (FIGS. 1 and 2). These rollers are hydraulically loaded by hydraulic load cylinders 212. Similarly, horizontal straightening section 3 includes driven straightening rollers 311 which are hydraulically loaded by hydraulic load cylinders 312. Since the wire undergoes no reduction in straightening devices 2 and 3, all of the rollers 210, 211 and 311 are driven at the same peripheral speed, represented by $N_0$ in FIG. 8. For purposes of this application, it will be assumed that all drive reels or rollers are of the same diameter, although it will be readily appreciated by those skilled in the art that rollers 211 and 311 will in practice be substantially smaller than the reels of capstans 6, 7, 12, 13 and 16 and that routine compensation factors for such differences will be required. $N_0$ is a lesser rate of rotation than is $N_{1A}$ due to the reduction of the wire from $d_0$ to $d_1$ in self-compensating die 5. The control system for controlling these relative rates of rotation will be described more fully hereinafter.

Similarly, final drive capstan 16 of section C (FIGS. 5, 6 and 8) operates at a slightly greater rate of rotation $N_f$ than does drive capstan 13 since the wire undergoes a reduction from diameter $d_2$ to $d_f$ in final self-compensating die 15. Final drive capstan 16 is conventional and is of a construction similar to that of drive capstans 13 and 7. Its control relative to the other drive is set forth more fully hereinafter.

Figure 9:
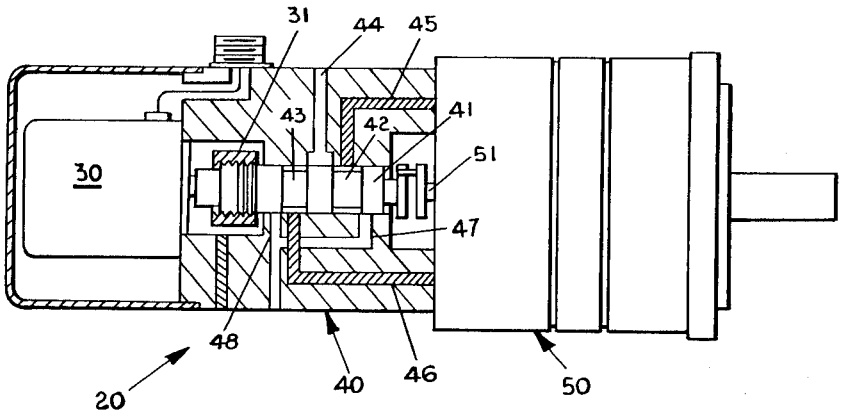
FIG. 9 is a partially cross-sectional view of an electro-hydraulic stepper motor system utilized in the apparatus of the present invention to effect a drive pursuant to a digital control signal.

To facilitate system control, all of the driven wheels or rotors are driven by drive means capable of responding to digital information. FIG. 9 discloses such a drive assembly 20, which is an electro hydraulic stepper motor comprising an electrical stepper motor 30, a servo valve control 40, and hydraulic motor 50. Such electrohydraulic stepper motors are conventional and are available from companies such as Washington Scientific Instruments, Inc. Servo valve 40 includes a spool 41 which is coupled to the drive shaft 51 of hydraulic motor 50 such that it rotates therewith, but such that it is capable of sliding axially with respect thereto. At its other end, spool 41 is threadably received in a "rotary-linear translator" 31 mounted on the output shaft of stepper motor 30. Any difference in the rate of rotation of hydraulic motor 50 and stepper 30 will cause spool valve 41 to shift either to the left or to the right opening either channel 42 or 43 to oil inlet port 44. The oil then flows either through passageway 45 or 46, through hydraulic motor 50 and then out through the other of passageway 45 or 46 and through either return passageway 47 or 48. Assuming that flow through passageway 45 drives hydraulic motor 50 in a clockwise direction, and assuming that stepper motor 30 experiences an acceleration in the receipt of electrical pulses and thereby begins stepping at a faster rate in a clockwise direction, spool 41 will thread to the left in translator 31, causing more oil to flow into channel 42 and from thence into passageway 45, thereby causing hydraulic motor 50 to speed up accordingly. The reverse possibility will also be appreciated by those skilled in the art.

Figure 10:
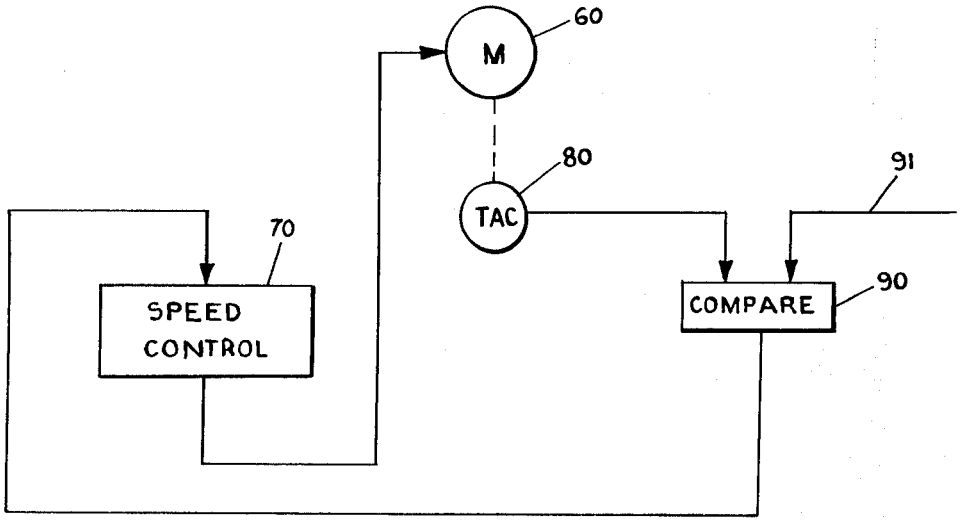
FIG. 10 discloses a circuit for controlling a DC motor as an alternative to the electro-hydraulic stepper motor of FIG. 9.

An alternative drive system (FIG. 10) includes a conventional DC motor 60 driven by means of a digital speed control 70. A tachometer 80 measures the angular displacement of motor 60, sends the resulting digital information to a comparator circuit 90 which compares that information to a digital control signal 91, set in accordance with the desired rate of rotation for motor 60, which then feeds the information to a digital speed control 70 which drives motor 60 at whatever rate necessary to eliminate any difference between the tac 80 readout and the signal received through line 91 in comparator circuit 90.

III. Processing Section B

A. The Heating Means 8

Heating means 8 is a generally conventional type of resistance heating device available from sources such as H. P. Norling Company, a Division of Interstate Drop Forge Co. Referring to FIGS. 3 and 4, such devices basically comprise a set of roll contacts 810, at the ends of the machine, which are wired to ground and two sets of roll contacts 811 therebetween which are wired to a power source. Other types of heat sources, such as gas burners, could be used, and an acceptable gas burner is described in conjunction with the forming head of our pipe cage end-forming machine disclosed in our copending patent application entitled "Pipe Cage End-Forming Machine", filed on even date herewith, invented by ourselves and having the Ser. No. 542,342. The disclosure of that application is incorporated herein by reference.

Figure 11:
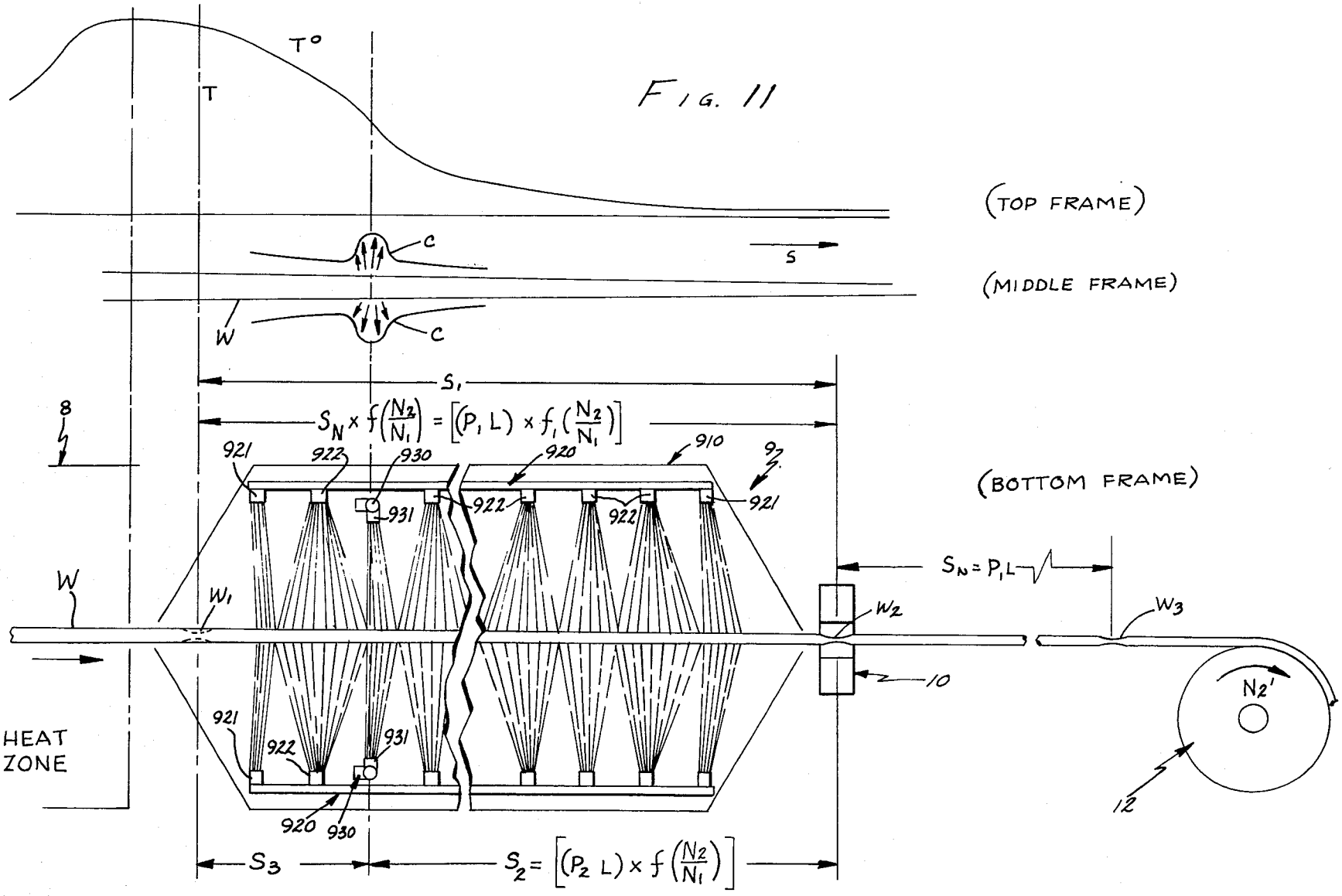
FIG. 11 includes three related frames, including a schematic cross-sectional view of the quenching means in the bottom frame, a representation of the manner in which the wire is reduced in the vicinity of the juncture of the heating means and quenching means and in the top frame a curve indicating what happens to the temperature of the wire as the wire proceeds through the heating means and into the quenching means.

Heating means 8 must be capable of heating the wire to a temperature above its austenite conversion point in a relatively short amount of time, preferably to above about 2000°F. Further, the maximum temperature should be concentrated as close to the quenching station 9 as possible. Wire will be processed through the apparatus at speeds of 1000 to 2000 feet per minute. Th austenite conversion temperature naturally varies for steels of different carbon contents, as is appreciated by those skilled in the art. A temperature of 2000°F. is well above the austenite conversion temperature for known steels and it has, in fact, been found preferable to heat the wire to temperatures of at least 2000°F. At these temperatures, the yield point of the steel is substantially reduced and accordingly, is readily and substantially elongated due to the difference in rates in rotation $N_1$ and $N_2$ of drag drive capstan 7 on the one hand and elongating drive capstan 12 on the other. Basically, the bulk of this elongation takes place at the end of heating means 8 and, at higher speeds, actually within quenching station 9. At lower speeds, a red-hot cone can actually be observed at the end of heater 8, with the wire narrowing down from its diameter $d_1$ to its diameter $d_2$. At higher speeds, the cone is more stretched out as illustrated in FIG. 11, and actually tends to shift downstream. Also, it is expected that the cone will begin forming at the end of heating means 8 and actually extend into quenching means 9.

A conventional optical pyrometer 812 is located at the end of heating means 8, generally at the junction of heating means 8 and adjacent quenching means 9. An optical pyrometer 812 is used for two reasons. First, it is important that nothing extraneous engage the wire at this very hot point. Secondly, it is important that a device be used which can "look in" as opposed to something which has to bracket the wire and thereby be positioned between heating means 8 and quenching means 9. This is because heating means 8 and quenching means 9 should be located as closely together as possible.

B. Quenching Means 9

Figure 12:
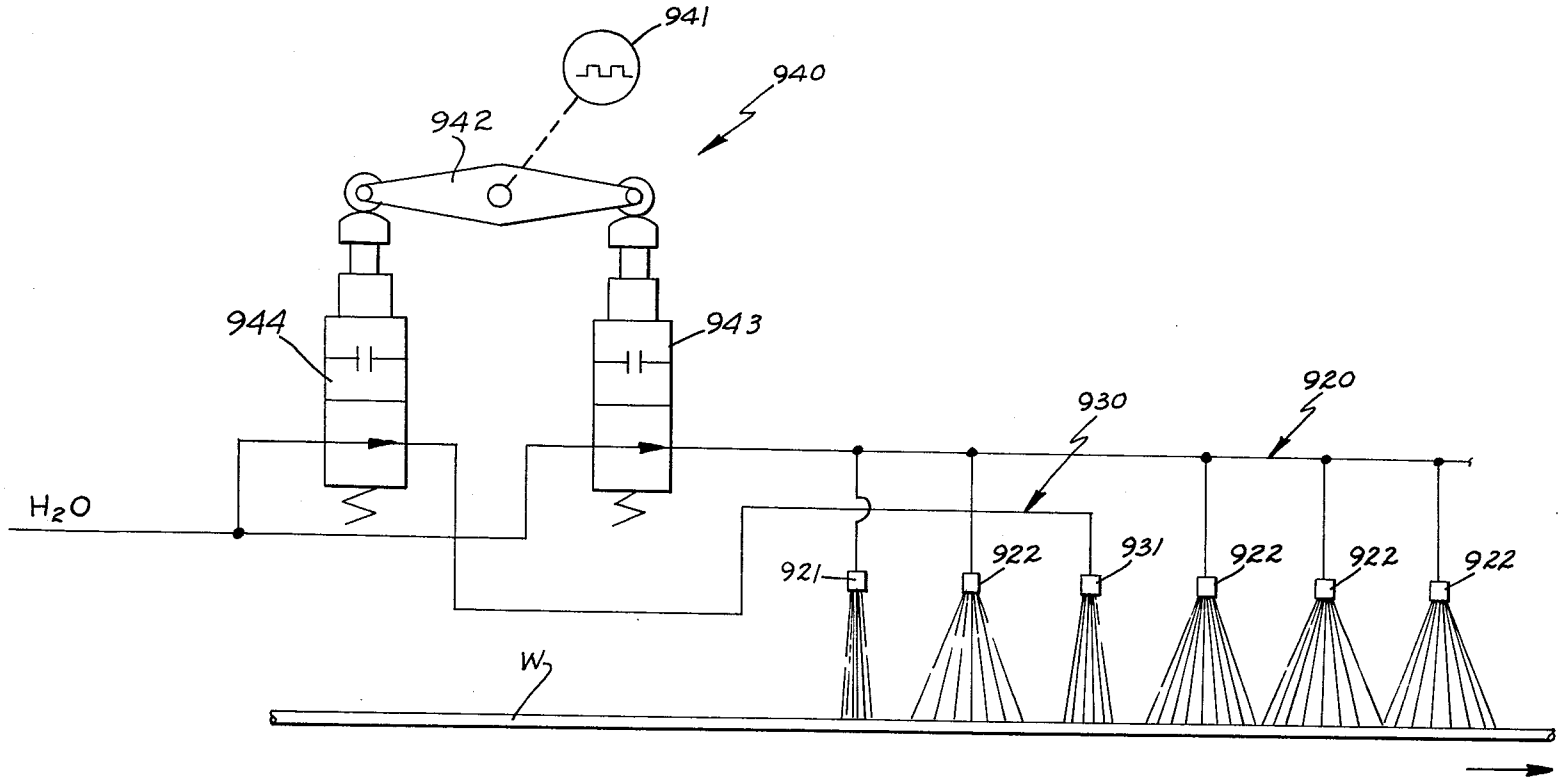
FIG. 12 is a schematic drawing indicating the valve control yoke for the quenching means.

Quenching means 9 (FIG. 11) is a water-quenching device comprising a housing 910, a primary spray manifold 920, a neck control manifold 930, and a manifold control valve assembly 940 (see FIG. 12). Manifold 920 includes at least two diametrically opposed "screen-type" nozzles 921 at each end of housing 910 to help prevent water from spraying out of the ends of housing 910. The remaining are a plurality of opposed industrial spray nozzles 922 which impact the wire with water. Neck control manifold 930 feeds a pair of oppositely disposed blast-type nozzles 931 which deliver a very concentrated blast of water at a relatively concentrated point on the wire W.

The function of neck control manifold 930 and its blast nozzles 931 is to prevent irregular necks from forming in the wire during the start up of the elongation operation, and at the maximum elongation limit. Therebetween, neck forming is much less prevalent and does not constitute a problem. The bottom frame of FIG. 11 (it will be noticed that FIG. 11 includes three frames which are correlated as to location) shows an incipient neck $W_1$ (exaggerated) beginning to form at the head of the reducing cone. It is the function of blast nozzles 931 to blast a strong spray of quenching water on this point $W_1$ to rapidly cool it and prevent it from necking down any further. Accordingly, blasting nozzles 931 are located at the left end of quenching housing 910. Due to the rapidity with which the wire is moving, i.e., between 1,000 and 2,000 feet per minute, the wire reduction cone will tend to be located actually inside of the quenching housing 910 and accordingly, the neck control blasting nozzles 931 may be located one or two primary nozzles away from the end of housing 910. It will be moving so fast that blast nozzles 931 must be located to the right of the point where neck W is formed so the system will have sufficient time after locating W, to respond by increasing water flow through neck control blast nozzle 931. The increased cooling rate at the point where nozzles 931 are located is indicated by the cooling rate lines C in the middle frame of FIG. 11 and by the temperature line of the temperature versus distances graph in the top frame of FIG. 11. It can be seen that the temperature T° increases sharply and reaches a maximum at the end of heat chamber 8 and then begins to decrease sharply inside the quenching chamber 9 as the quenching begins.

The primary and necking control manifolds 920 and 930 are controlled by a manifold control valve system 940 (FIG. 12). Either more water is directed to neck control manifold 930 and less to primary manifold 920, or more water is diverted to manifold 920 and less to manifold 930. The overall quantity of quenching water entering the system remains constant at all times. This exaggerates the effect of quenching blasts from nozzles 931 and also, by decreasing the flow to the first screen nozzle 921 and the second spray nozzle 922, allows the material adjacent to the incipient neck to have a larger deformation (or reduction) thereby assisting in eliminating the incipient neck. Valve assembly 940 includes a stepper motor 941 which pivots a yoke 942 which in turn controls a valve 943 which feeds water to the primary manifold 920 and a valve 944 which controls the flow of water to the necking control manifold 930. The quenching control system described hereinafter acts to operate stepper motor 941 and thereby regulates the relative opening in the two valves 943 and 944.

C. Electronic Gauge Means 10

Electronic gauge means 10 is located just downstream in the direction of flow of wire W from quenching means 9. it gauges the diameter of wire W as it leaves quenching means 9 and thereby provides system control information.

Figure 13:
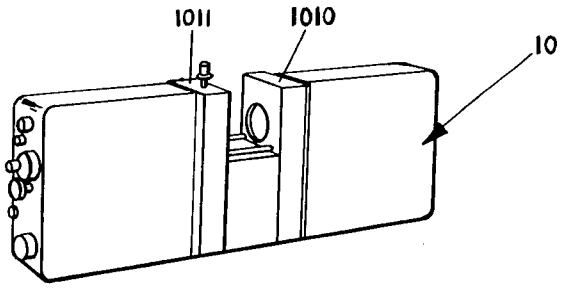
FIG. 13 is a perspective view of the type of wire diameter gauging device utilized in the apparatus of the present invention.

FIG. 13 discloses the electronic gauge or sensor 10. It is a conventional device operating on a photoelectric principle by passing light in a plane across the path which the wire follows. Basically, the wire W passes between a light generating cell 1010 and a light receiving cell 1011. Conventional wire measuring devices of this type are available from companies such as The Electron Machine Corporation.

D. Optional Tempering Means 11

The tempering means 11 is simply another heating stand comparable to heating means 8, except that it is operated at much lower temperatures, i.e., tempering temperatures, than is heating means 8. It is to be used with medium carbon steels and probably would get its greatest use if high carbon steels were processed in this system. It is conceivable that this might be used on low carbon steels as well to obtain an optimum combination of U.T.S. and flexiblity.

I.V. CONTROL FOR SECTION B

A. Drive Control

Figure 14:
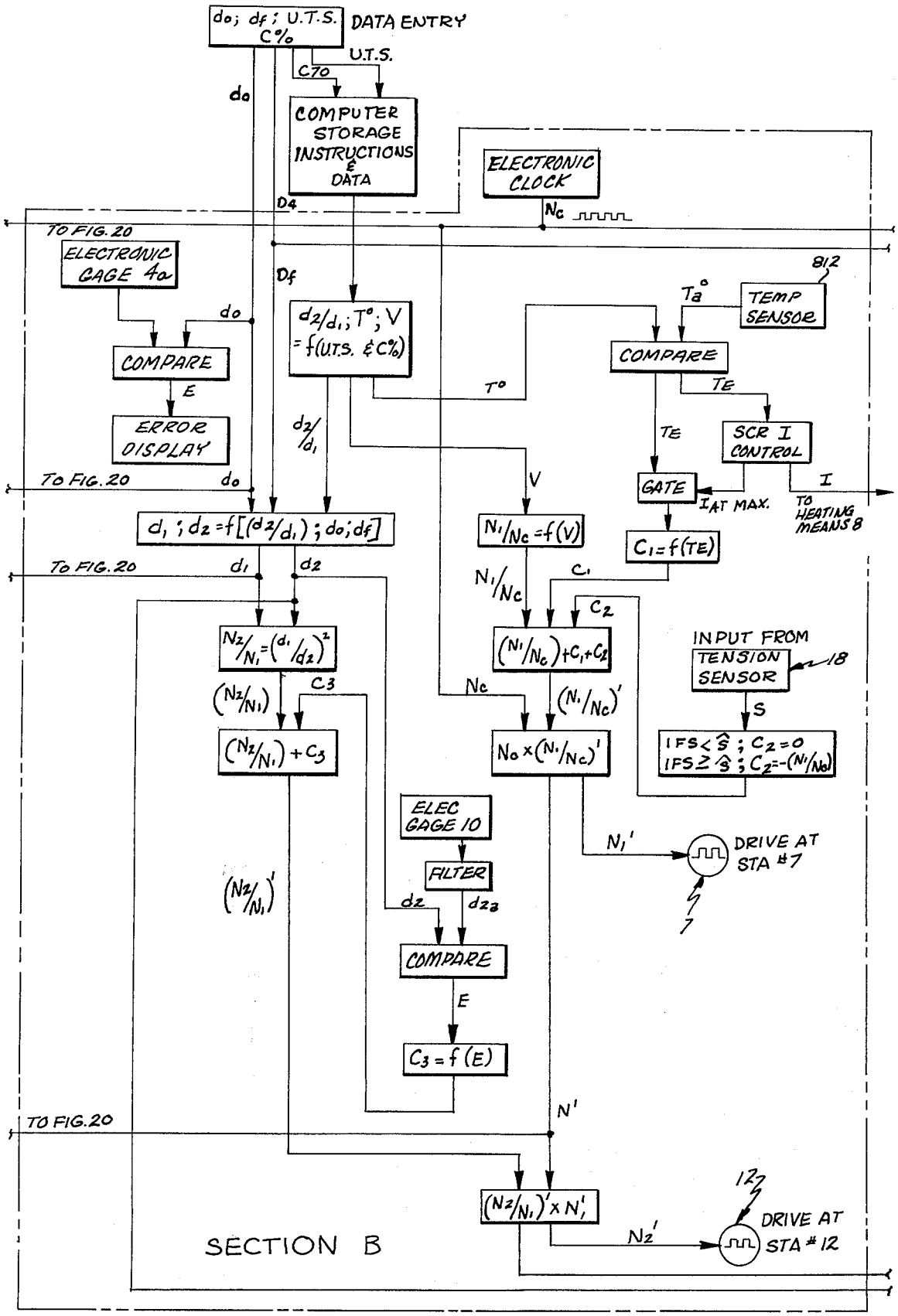
FIG. 14 is a logic diagram for controlling the section B apparatus of the present invention.

A logic diagram for controlling drive capstans 7 and 12 and for controlling heating means 8 is shown in FIG. 14. The logic shown therein can be carried out in conventional digital control devices including a computer, such as the type of digital computer available from Digital Equipment Corporation, and a programmable controller of the type available from Modicom, Inc. Combinations of such existing equipment can be utilized.

Beginning at the top of FIG. 14, an operator enters the following data into the Data Entry phase of the system:

the diameter of the green wire with which he is starting, $d_0$;

the final diameter of wire which he wants to achieve, $d_f$;

the ultimate tensile strength which he seeks, U.T.S.;

the carbon content of the green rod or wire, C%.

The U.T.S. and carbon content C% are fed into a computer storing instructions and data. As has been indicated in the summary of the invention, U.T.S. is a function of the starting carbon content, a function of the reduction ratio of the wire for processing section B, $d_2/d_1$, a function of the temperature to which the wire is heated by heating means 8, and a function of the velocity V which the wire travels through section B and the overall apparatus. Other desirable physical properties such as desired ductility and the like may be imputed into the computer and the U.T.S. may actually be computed up or down in a computer calculated trade off to achieve the optimum of all desired physical properties. The computer has been preprogrammed with experimental results and other information necessary to determine these factors as a function of the desired U.T.S. and the wire carbon C%. The velocity determination is controlled by the amount of production in tons which the system is capable of achieving. Since tonnage is a function of final diameter $d_f$, velocity is determined basically as a function of the final diameter $d_f$ and by the speed limitations of the system. The operator wants to produce so many tons of wire per hour and the volume of wire having a diameter $d_f$ which will produce that tonnage must pass through the apparatus at a velocity V which will be a function of the tonnage production rate and the final diameter $d_f$. Fixing the velocity in this way has the advantage of automatically causing larger diameter wire to travel more slowly than smaller diameter wire. This gives heating means 8 a better opportunity to heat the wire to the required temperature and "to the core", and in fact the rate at which heating means 8 can heat the wire is a key limiting factor on what the maximum V can be.

The temperature T° may be a variable, but is generally preprogrammed above about 2000°F. It is known that the temperature must be above the austenite conversion temperature and temperatures of about 2000°F. are most preferable. The program in the computer may allow for some interplay between temperature T°, velocity V, and reduction ratio $d_2/d_1$ within the aforementioned parameters. Accordingly, the reduction ratio $d_2/d_1$ is determined as a function of the entered data as to ultimate tensile strength U.T.S. desired and carbon content C% of the incoming wire, and as a function of the temperature and wire velocity as determined by the computer within the above parameters.

The rate $N_1'$ at which drive capstan 7 must be rotated is determined as a function of velocity V and to a certain extent as a function of wire temperature T°. In the logic circuit, $N_1'$ is represented by electrical pulses. These pulses are provided by an electronic clock shown near the top of FIG. 14. The rate $N_2'$ at which capstan 12 must be rotated is a function of $N_1'$ so that capstan 12 follows capstan 7 proportionally.

Velocity V as determined above is fed into a logic circuit which establishes the ratio of a desired rate of rotation $N_1$ for drive capstan 7 to the rate $N_c$ at which pulses are emitted from the electronic clock as a function of velocity V. The ratio $N_1/N_c$ is transmitted to an additive circuit for adding correcting factors $C_1$ and $C_2$ which are functions of temperature T° and excessive tension between drive capstans 7 and 12, respectively. Turning first to the temperature compensating factor, pulses reflecting the desired temperature T° are fed to a comparator circuit which compares the desired temperature T° with the actual temperature $T°_a$ with *a* standing for "actual", as determined by temperature sensor 812 (FIG. 3). The temperature error TE determined thereby is fed both to an SCR current control for heating means 8 and to a gate circuit. From the SCR current controls, any required changes in current I in order to adjust the wire temperature to the desired temperature T° are transmitted to the heating means 8. The SCR current control also delivers a signal to the base of the aforesaid gate. If the current in heating means 8 is at the maximum capacity of the power supply and still greater heat is required to increase the actual $T°_a$ to the desired temperature T°, the signal at the base of the gate will open the gate allowing information as to the temperature error TE to be fed to a correction circuit for determining a correction factor $C_1$ as a function of the temperature error TE. $C_1$ is then added to the ratio $N_1/N_c$ in an adding circuit and has the net result of causing drive capstan 7 to slow down. Since drive capstan 12 is driven in accordance with a particular ratio, it will slow down accordingly. As the slowdown occurs, the wire temperature at the heating means 8 will increase by reason of the fact that wire is moving slower therethrough. Once the wire is back up to temperature and the heating means 8 has caught up, the correction factor $C_1$ will again approach zero and the drive capstan 7 (and drive capstan 12) will again stabilize.

To determine the second correction $C_2$, a tension sensor 18 shown schematically connected to drive capstans 7 and 12 is provided to sense the tension therebetween. If the tension level exceeds a certain predetermined safety factor $\hat{S}$, the machine could be damaged. It is desirable at this point to momentarily stop drive capstans 7 and 12 altogether, with the built-up tension locked therebetween, to allow the wire W to heat up again and by reason of the resulting lowering of yield point cause the tension between drive capstans 7 and 12 to drop back below the safety level $\hat{S}$. Stoppage is effected by the fact that if S is greater than $\hat{S}$, $C_2$ equals $-(N_1/N_c)$. The adding circuit adding $N_1/N_c$ to $C_2$ will sum a zero and will emit zero pulses. If the tension S as sensed by tension-sensor 18 is less than the safety factor $\hat{S}$, the correction factor $C_2$ will be zero.

It can be seen that the ratio $N_1/N_c$ is thus corrected in the summing circuit by the correction factor $C_1$ and $C_2$. The resulting corrected ratio $(N_1/N_c)'$ is fed into a multiplier circuit which multiplies the ratio $(N_1/N_c)'$ by $N_c$, the pulse rate from the electronic clock, and the resulting corrected drive rate $N_1'$ for drive capstan 7 is fed, as a number of pulses, to the electro hydraulic stepping motor for drive capstan 7. As can be seen by reference to FIG. 14, the $N_1'$ pulses are also fed to the multiplier circuit which determines the correct drive rate $N_2'$ for drive capstan 12 by multiplying the corrected ratio of $(N_2/N_1)'$ by $N_1'$.

The ratio $(N_2/N_1)'$ is determined ultimately by all of the input data, original wire diameter $d_0$, the final wire diameter $d_f$, the carbon content C%, and the ultimate tensile U.T.S. as corrected by a correcting factor.

Proceeding from this computation block, $d_2/d_1$, the reduction ratio, is inputted into a logic circuit for computing $d_1$ and $d_2$ separately as a function of the reduction ratio, $d_2/d_1$, the initial wire diameter $d_0$ and the final wire diameter $d_f$. As can be seen by FIG. 14, $d_0$ and $d_f$ are fed directly into this logic circuit from "data entry". Basically, $d_2$ is determined as a function of $d_f$ since it is known that $d_f$ must be just slightly smaller than $d_2$ such that the final self-compensating die 15 can even out the slight deviations which will occur in $d_2$ as a result of processing in section B. Given $d_2$, $d_1$ can then be determined directly from the reduction ratio $d_2/d_1$. $d_0$ is fed into this logic circuit only in the event that the difference between $d_1$ and the original wire diameter $d_0$ is greater than can be produced by initial self-compensating die 5. If this is the case, $d_1$ will be increased to a point within the range of the initial self-compensating die 5 and the difference between $d_2$ and the final wire diameter $d_f$ will be increased accordingly.

$d_1$ and $d_2$ are then fed into a circuit for converting the reduction ratio into the ratio of the rates of rotation of the indentically diametered reels of drive capstans 7 and 12. This ratio is $N_2/N_1$ and is equal to the inverse of the reduction ratio squared, i.e., $(d_1/d_2)^2$.

In order to ensure the accuracy of the drive ratio $N_2/N_1$, electronic gauge 10 gauges the actual wire diameter. The gauge reading is fed to a filter circuit which ignores momentary sharp deviations caused by necks and the resulting signal reflects the actual wire diameter $d_{2a}$, ignoring necks, with the *a* standing for actual, as it leaves quenching means 9. This information is fed to a comparator circuit which also receives a signal as to the desired $d_2$. The error determined is fed into a circuit for determining a correction factor $C_3$ as a function of that error and $C_3$ is in turn fed into a correction circuit for adding to drive ration $N_2/N_1$. The resulting corrected drive ratio $(N_2/N_1)'$ is then fed to a multiplier circuit for determining $N_2'$ by multiplying the corrected drive ratio $(N_2/N_1)'$ by the corrected drive rate $N_1'$. Corrected $N_2'$ is then fed to the electro hydraulic stepper motor for drive capstan 12 and thereby rotates the stepper motor in accordance with the number of pulses $N_2'$ transmitted.

FIG. 14 also discloses the logic necessary for ensuring that the operator has not made a mistake either in supplying the initial wire diameter information $d_0$ or in selecting green rod or wire for introducing into the system from load and pay station 1 or 1*a*. The input $d_0$ is fed into a comparator circuit which compares $d_0$ with the information received from the electronic gauge 4*a* (FIGS. 1 and 2) in section A. If there is an error, that error E is displayed on an error display on the control panel. The operator must then locate his mistake and correct it.

B. Quench Necking Control

The control of necks $W_1$ can be achieved as a result of the fact that when they form they tend to form at regular intervals. Referring to FIG. 11, electronic gauge 10 is used to determine the distance between adjacent necks, $W_2$ and $W_3$ and thereby predict the distance between a particular neck $W_2$ being gauged by electronic gauge 10 and a neck $W_1$ being formed some place in the vicinity of the beginning of quench housing 910. Three necks $W_1$, $W_2$ and $W_3$ are shown in FIG. 11.

$W_3$ at the far right has already passed through electronic gauge 10. $W_2$ is being guaged at this moment by electronic gauge 10 and $W_1$ is beginning to form at the front end of quench housing 910.

Basically, by gauging the distance $S_n$ between necks $W_2$ and $W_3$, the electronic gauge 10 can be used with appropriate circuitry to predict when an incipient neck $W_1$ forming at the front end of quench housing 910 will reach quench-blasting nozzles 931. This information is then used to operate stepper motor 941 in such a way as to shift valves 943 and 944 to increase the flow of water to blast nozzles 931 and decrease the flow to primary manifold 920. However, because the wire W is being elongated and reduced in diameter between the time of the incipient formation of neck $W_1$ and the point of gauging neck $W_2$ at electronic gauge 10, the distance $S_1$ between incipient neck $W_1$ and neck $W_2$ will not be precisely equal to the distance $S_n$ between necks $W_2$ and $W_3$. It will be somewhat less. The extent to which it will be less will be a function of the reduction ratio $d_2/d_1$ or a function of the drive ratio $N_2/N_1$. In other words, $S_1$ will equal $S_n \times f_1(N_2/N_1)$. $S_n$ in turn is determined by the number of pulses $P_1$ fed to the drive motor for drive capstan 12 in the time it takes $W_2$ to travel to the point at which $W_3$ is in FIG. 11, multiplied by the length of wire L which passes over the reel of drive capstan 12 per each digital drive pulse to its electro hydraulic stepper drive motor. Thus, $S_n = P_1L$ and $S_1 = P_1L \times f_1(N_2/N_1)$.

The distance which incipient neck $W_1$ must travel from the time which $W_2$ is detected at electronic gauge 10 until the time at which neck $W_1$ is located in position for being quenched by blasting nozzles 931 is shown in FIG. 11 as $S_3$. The distance between blasting nozzles 931 and electronic gauge 10 is known and can be introduced into the logic circuitry as a function of the number of pulses $P_2$ which the stepper motor for drive capstan 12 would rotate in order to move a constant diameter strand of wire from blaster nozzle 931 to electronic gauge 10 times the length L of wire which passes over the reel of drive capstan 12 for each pulse. Because the wire diameter is still being reduced between blasting nozzles 931 and electronic gauge 10, this value must then be multiplied by some function $f_2$ of the reduction ratio, or of the drive ratio $N_2/N_1$. Thus, $S_2$, the distance between blaster nozzles 931 and electronic gauge 10 equals $(P_2L) \times f_2(N_2/N_1)$. For practical purposes, it can be assumed that $f_1(N_2/N_1)$ approaches $C_2(N_2/N_1)$. Thus, $S_3$ can be expressed as follows:

$$S_3 = (P_1 - P_2) \times f(N_2/N_1).$$

Figure 15:
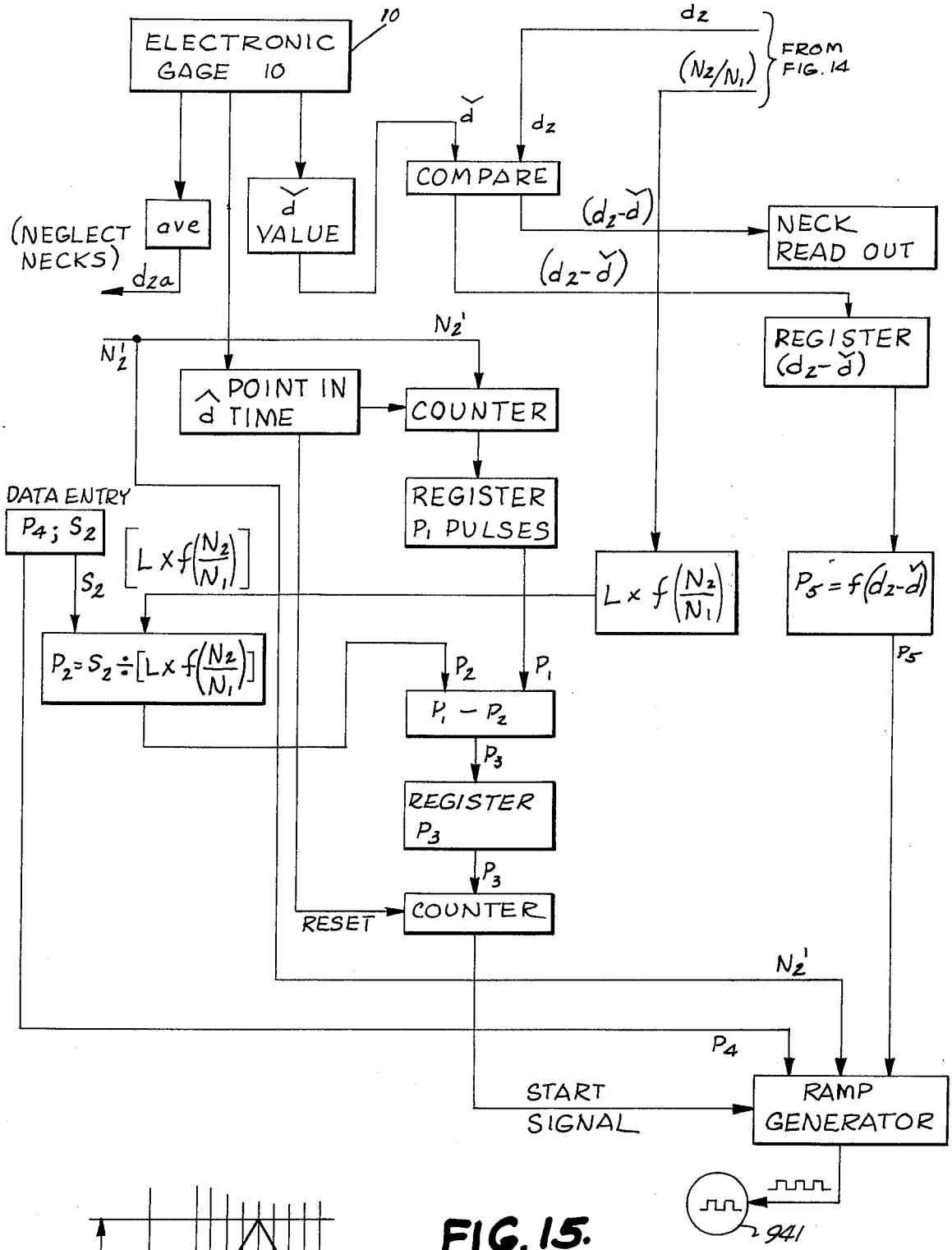
FIG. 15 is a logic diagram for controlling the quenching system of the section B apparatus.
Figures 16, 17:
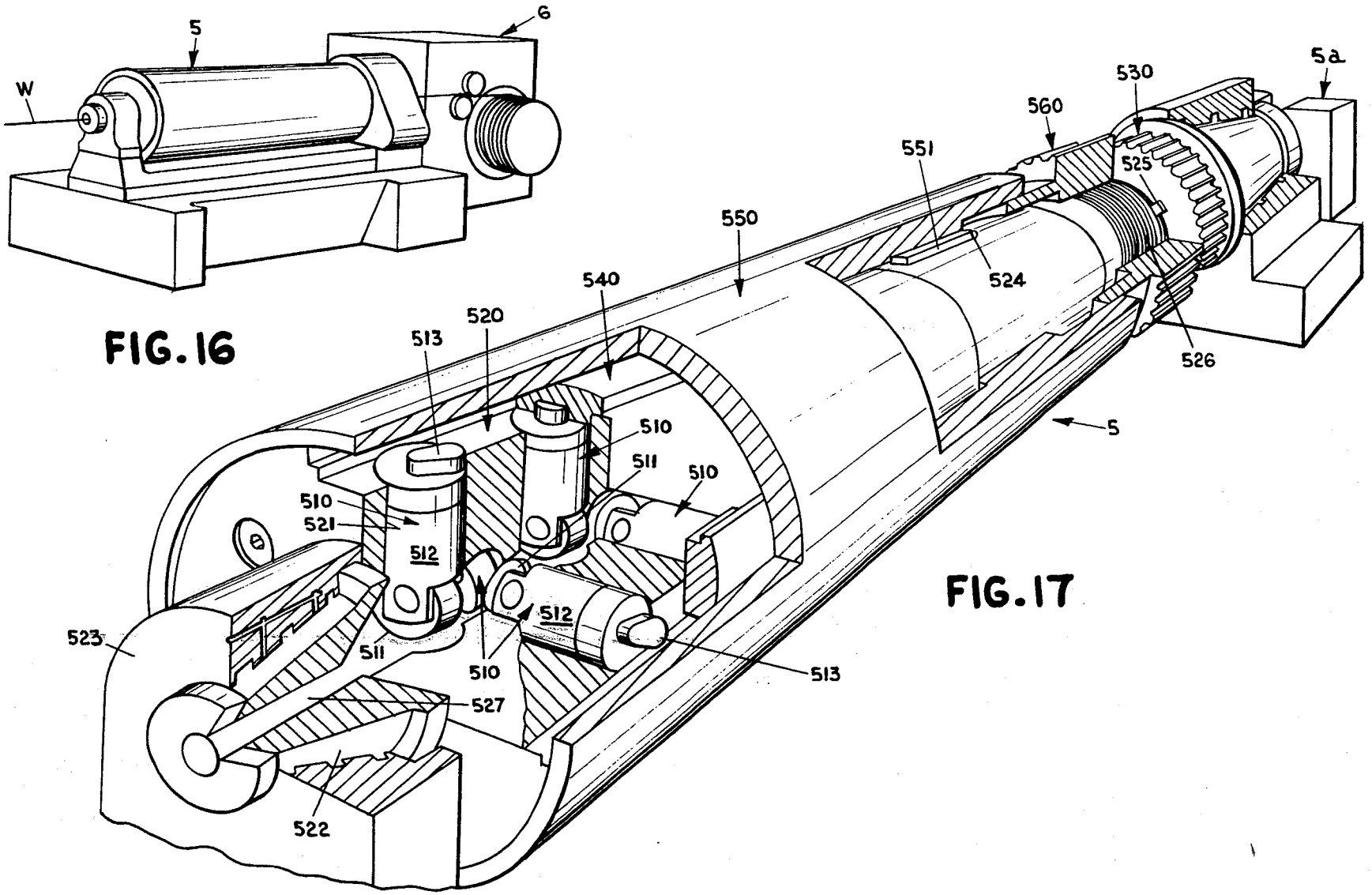
FIG. 16 is a perspective view of the self-compensating die employed in pretreating section A (an identical die being employed in post treating section C)
FIG. 17 is a fragmentary, perspective view of the self-compensating die.

This information is utilized in the logic diagram shown in FIG. 15 to determine the number of pulses $P_3$ ($P_3 = P_1 - P_2$) which must elapse after a neck $W_2$ is detected at gauge 10 before the incipient neck $W_1$ will be located at the neck inhibiting spray from nozzle 931.

Referring to FIG. 15, the information as to the drive ratio $N_2/N_1$ is fed in from the circuit shown in FIG. 14. Similarly, the desired wire diameter $d_2$ is fed in from the circuit shown in FIG. 14. The electronic gauge 10 is reshown in FIG. 15. In addition to the function which electronic gauge 10 serves in the FIG. 14 circuit, i.e., that of determining $d_{2n}$ by feeding its signal through a filtering circuit, electronic gauge 10 also provides a signal to one logic circuit which determines the point in time at which necks are occuring, by picking up approximately the low points in the necks, and to another logic circuit which determines the value of the deviating diameter $\check{d}$.

The information as to the point of time at which $\check{d}$ occurs is used to gate a counter which also receives pulses $N_2'$ picked off the circuit in FIG. 14 used to drive the electro hydrualic stepper motor of drive capstan 12. The passage of a neck tells the counter, via the point in time circuit, to start counting pulses $N_2'$. When another neck passes, the number of pulses $N_2'$ so counted are fed to the register and a new count is begun. The number of pulses $N_2'$ counted by the counter between the passage of successive necks $W_2$ and $W_3$ past gauge 10 and fed into the register equals $P_1$. The number of pulses $P_1$ are fed from the register into a substracting circuit for subtracting $P_2$ from $P_1$ and thereby determining $P_3$.

The number of pulses $P_2$ referred to above are generated by first feeding the drive ratio $N_2/N_1$ into a logic circuit which contains L, the length of wire passing over drive capstan 12 per one pulse to its stepper motor. This circuit multiplies L by a function of $(W_2/N_1)$, $f(N_2/N_1)$. $L \times f(N_2/N_1)$ is then fed into a logic circuit at the left-hand side of FIG. 15 along with $S_2$, the measured distance between blaster nozzles 931 and electronic gauge 10, as entered into the system through a manual data entry. $P_2$ is then determined since, as can be seen by reference to the formula in FIG. 11, $P_2$ equals $S_2$ divided by $L \times f(N_2/N_1)$. The $P_2$ thus generated is transmitted to the subtracting circuit and is subtracted from $P_1$ to yeild $P_3$.

$P_3$ is transmitted to a $P_3$ register and from thence to a counter. The counter is reset at the point in time at which a neck is measured at electronic gauge 10, said reset being accomplished by a signal from the logic circuit which establishes the points in time for $\check{d}$. From the time of reset, the $P_3$ counter counts pulses and at the time the number of pulses equals $P_3$, a ramp signal commences to be generated by a ramp generator which in turn activates stepper motor 941 to drive yoke 942 of valve control 940 (FIG. 12).

The extent to which stepper motor 941 shifts the flow of water from valve 943 to valve 944 is a function of the size of the neck. The greater the deviation, the greater the amound of shift. The manner in which this signal is generated can be seen by referring back to the circuit which generates the "value for $\check{d}$." The value for $\check{d}$ is fed to a comparator circuit which compares that value to the desired wire diameter value $d_2$. The resulting neck error $(d_2 - \check{d})$ is transmitted to a register which in turn transfers the information to a logic circuit which generates a digital signal $P_5$ as a function of the error $(d_2 - \check{d})$. The pulses $P_5$ are fed to the ramp generator and are used to establish the height of the ramp (see FIG. 15 inset). The width of the ramp is determined by a digital signal $P_4$, manually inputed by the operator at the "Data Entry" shown in FIG. 15. In essence, $P_4$ gives the amplitude signal $P_5$ a time frame. The operator can observe the "Neck Read Out" display shown in FIG. 15 to make necessary adjustments in $P_4$. The ramp generated operates stepper motor 941 in one direction to the extent of $P_5$ and back again over the time period determined by $P_4$.

In the above example, it has been assumed that the distance between successive necks, particularly $S_1$, will be greater than the distance $S_2$ between gauge 10 and neck control nozzles 931. If less, the system would not work as described. However, this can be compensated for by building into the "$P_1 - P_2$" logic a circuit for ignoring a first measured $P_1$ if $P_1 - P_2$ is negative. $P_1 - P_2$ would hold the first $P_1$ and add to at a second (or more) $P_1$ to get a positive value for $P_1 - P_2$. The system would then proceed as above.

V. Section A

A. Feeding, Straightening, and Descaling

Wire load and payoff stand 1 and its identical alternative 1a are conventionally used devices in the steel wire industry. Two are provided at section A (FIG. 1) such that as wire is about depleted on payoff stand 1, the leading end of a roll on stand 1*a* can be welded to the end of the roll on stand 1 and the wire as it finally pays out of stand 1 will begin to pay off of stand 1*a*. In this manner, the process will be continuous and uninterrupted. While wire is being paid off stand 1*a*, a new roll can be placed on stand 1.

Vertical and horizontal leveling rolls 2 and 3, respectively, are also conventional apparatus. Feeder rolls 210, driven rolls 211 and 311, and load cylinders 212 and 312 have been described hereinabove in conjunction with section II above, "DRIVE MEANS FOR ALL SECTIONS". The function of these leveling devices is conventional and is simply to ensure that the wire as it is fed into the processing section is straight and not kinky.

Descaler 4 has a similar conventional function. A conventional mechanical descaler can be used. Such devices may employ the ball peen or wire brush principles.

Electronic wire gauge 4a at the end of descaler 4 serves the purpose of determining the original wire diameter $d_0$ and feeds this information into the logic circuit disclosed in FIG. 14 to ensure that the operator has not made a mistake.

B. Self-Compensating Die 5

As noted above, a die means is required in section A in order to effect an initial reduction in the wire diameter prior to its being fed into processing section B. A conventional die or series of dies could be used. However, the unique self-compensating die disclosed herein, and disclosed and claimed in our copending patent application entitled "SELF-COMPENSATING DIE", Ser. No. 542,397, filed on even date herewith, the disclosure of which is specifically incorporated herein by reference, has two distinct advantages. First of all, it can be automatically adjusted through the control logic circuit to provide, within the range of its operability, an infinite number of different diameter reductions from $d_0$ to $d_1$. Thus, $d_1$ can vary from operation to operation and the same diameter $d_0$ green stock can be utilized by merely changing the setting for self-compensating die 5. In the alternative, the self-compensating die 5 allows use of different green stock of differing diameters $d_0$ for achieving the same initial section B diameter $d_1$.

The second advantage of self-compensating die 5 is that it adjusts itself for any wear which may show up in its wire-reducing members. When a conventional die begins to wear, error creeps into the diameter of the wire and when the error becomes large enough, the die must be changed completely and a new die utilized.

The self-compensating die 5 of the present invention, shown particularly in FIGS. 16–19 (corresponding to FIGS. 1–4 of the aforesaid self-compensating die application) includes a plurality of pairs of roller assemblies 510 carried in a rotating rotor 520 rotatably driven at one end through a rotor drive gear 530, which is itself ultimately driven by the drive capstan 6. The angle of orientation of the roller assemblies and with respect to the wire passing therebetween (through the center of rotor 520) and the amount of pressure which the roller assemblies exert on that wire are controlled by cams 540 which are bolted to the inside of sleeve 550 which surrounds rotor 520 and which is keyed for simultaneous rotation therewith by a key 551 slidably received in a keyway 524 in rotor 520. Sleeve 550 is slidable axially relative to rotor 520 and when so moved, cams 540 operate on roller assemblies 510 to change their angular orientation and their distance from the center line of rotor 520. This axial adjustment is achieved by an adjusting gear 560 which is threadably received on rotor 520 at one end thereof and which is threadably received in sleeve 550 at one end thereof. The respective receiving threads on sleeve 550 and on rotor 520 are of a different pitch. Adjusting gear 560 is normally driven at the same rate of rotation as rotor drive gear 530. However, the pitch of the theads on rotor 520 and the pitch of the threads in sleeve 550 are different so that when a differential rotation is introduced through a drive and differential assembly 570 (FIG. 18), adjusting gear 560 is rotated relative to rotor 520 and sleeve 550, thereby threadably moving on both and causing an axial shift of sleeve 550, and the cams 540 bolted thereto, with respect to rotor 520. This adjustment effected through differential assembly 570 is achieved as a result of a signal which compares the actual wire diameter $d_{1a}$ at electronic wire gauge 5*a* (FIGS. 1, 2 and 17) with the desired wire diameter $d_1$ which is originally programmed into the system.

Differential assembly 570 includes a primary drive shaft 571 which is driven by a transmission from the drive for capstan wire drive 6. It is important that the rate of rotation of rotor 520 and sleeve 550 be proportional to the rate at which wire is pulled therethrough since the angle $\theta$ of the roller assemblies 510 to the lateral cross-section of the wire is a function of the diameter of the wire, the speed with which the wire is moved and the rate at which the rotor 520 and sleeves 550 are rotating. By locking the wire drive and the rotor drive with respect to one another, this angle $\theta$ for each of the different pairs of rollers 510 remains constant for a given position of the rotor with respect to its particular cam 540. Further details as to the relationship between the roller assemblies 510 and the cams 540 and the angle $\theta$ are set forth in the aforesaid copending patent application entitled "SELF-COMPENSATING DIE" which is, as noted hereinabove, specifically incorporated herein by reference.

Figures 18, 19:
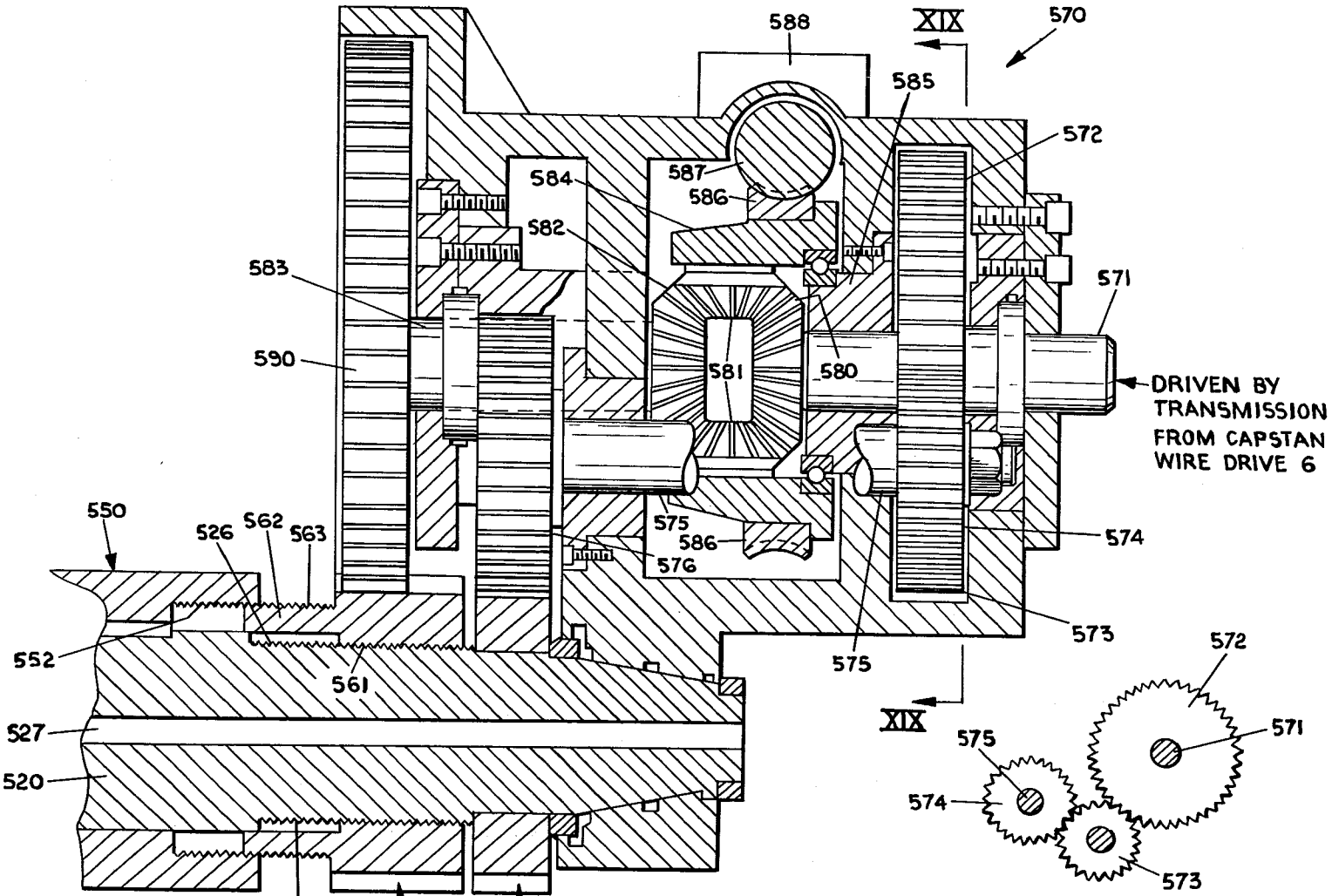
FIG. 18 is a generally cross-sectional view of the differential control system for the self-compensating die.
FIG. 19 is a cross-sectional view taken generally along plane XIX—XIX of FIG. 18.

Primary drive shaft 571 drives rotor drive gear 530 through a primary drive gear 572, which in turn drives idler gear or reversing gear 573, which in turn drives a secondary drive gear 574 on a secondary drive shaft 575 and through a third drive gear 576 mounted on the end of secondary drive shaft 575. Third gear 576 then directly drives rotor drive gear 530. Primary drive gear 572, idler drive gear 573, and secondary drive gear 574 are also shown in FIG. 19.

Primary drive shaft 571 is also connected directly to the input pinion 580 of a differential gear unit. Input pinion 580 drives a carrier or spider gears 581 which in turn drive an output pinion 582. An output shaft 583 extends from output pinion 582 and drives an output drive gear 590 which in turn drives adjusting gear 560.

The carrier gears 581 are rotatably mounted on th carrier 584 which is in turn rotatably mounted on a bearing 585 for primary drive shaft 571. Carrier 584 includes a circumferential worm track 586 which is engaged by a worm 587. Worm 587 is driven by a stepper motor 588 in accordance with a control signal indicating that cams 540 and thereby the relative radial locations and angles $\theta$ of roller assemblies 510 should be changed.

VI. Section A Control

Figure 20:
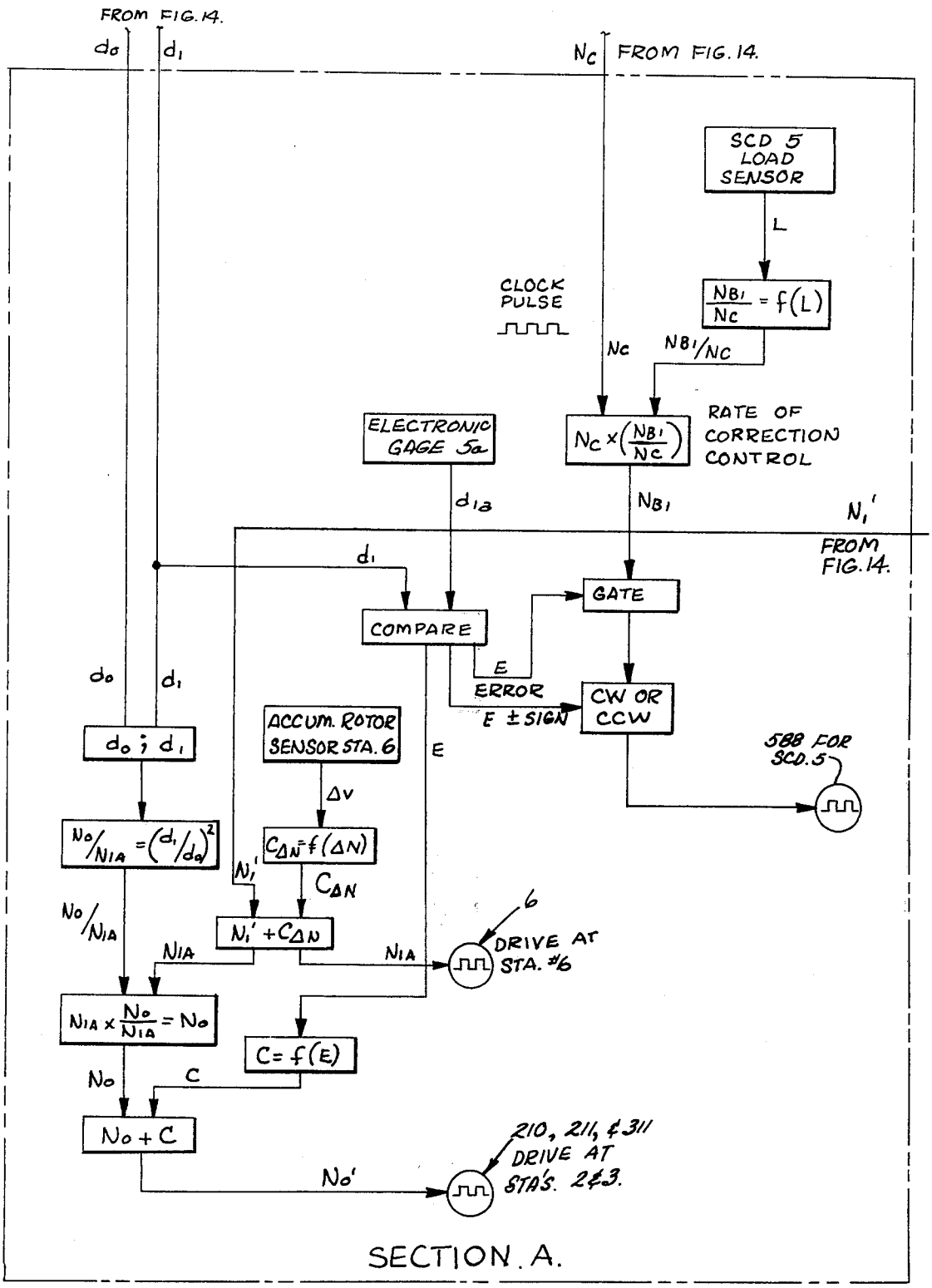
FIG. 20 is a logic diagram for controlling section A of the apparatus.

Referring again to FIG. 8, it will be recalled that the difference between the rates of rotation $N_1'$ and $N_{1A}$ for drive capstans 7 and 6 is the play in the accumulator rotor 61 of drive capstan 6. Referring to FIG. 20, it will be seen that the actual, corrected pulses driving capstan 7, i.e., $N_1'$, are transmitted to a logic circuit for adding $N_1'$ to a correction factor based upon an accumulator rotor sensor on capstan at station 6. (Follow the line $N_1'$ from approximately the middle and right-hand side of FIG. 20). A signal based on the difference in the rates of rotation of the inside reel 611 and outside reel 614, i.e. $\Delta N$, is fed into a correction factor logic circuit and a correction factor $C_{\Delta N}$ is calculated as a function of $\Delta N$. The pulses generated as a result are fed into an addition circuit and added to $N_1'$ and the resulting pulses $N_{1A}$ are fed to the electrohydraulic stepper motor for drive capstan 6.

The pulses $N_{1A}$ are also fed to a multiplier circuit which multiplies the $N_{1A}$ pulses by the ratio of the rates of rotation of feeder and leveling rollers 210, 211 and 311 respectively to the rate of rotation of drive capstan 6, i.e., $N_0/N_{1A}$ to yield a resulting series of pulses $N_o$. The ratio factor $N_0/N_{1A}$ is generated based on the original wire diameter $d_0$ and the desired wire diameter $d_1$ for the wire after it leaves self-compensating die 5. The ratio $N_0/N_{1A}$ will equal $(d_1/d_0)^2$. The resulting data representing $N_0/N_{1A}$ is then fed into the multiplier circuit and multiplied by $N_{1A}$ to yield the pulses for $N_0$. The pulses $N_0$ are then fed into a correcting circuit which compensates for actual differences between the desired wire diameter $d_1$ and the actual wire diameter $d_{1a}$ of the wire as it leaves self-compensating die 5. Referring to the top of FIG. 20, it can be seen that the pulses for the desired wire diameter $d_1$ which is determined in the logic circuit of FIG. 14 are fed into a comparator circuit which compares them to the data generated by the electronic gauge 5a at the end of self-compensating die 5. The electronic gauge 5a generates data $d_{1a}$ representing the actual wire diameter of the wire art electric gauge 5a. The two are compared and the resulting error E is transmitted first of all to an error circuit which calculates a correction factor C as a function of the error E. The correction factor C is then fed into an addition circuit which adds the pulses C to the pulses $N_0'$ to yield the pulses $N_0'$ which establish the rate of rotation of the electro-hydraulic stepper motors for rollers 210, 211 and 311, respectively.

The error E between the actual wire diameter $d_{1a}$ and the desired wire diameter $d_1$ at electronic gauge 5a is also utilized to effect an input to electro-hydraulic stepper motor 588 for worm drive 587 in the differential 570 for self-compensating die 5. The error signal E is fed to the base of a gate and a signal indicating the polarity or sign on the error is fed to a reversing circuit capable of generating a clockwise or a counterclockwise motion in stepper motor 588. If there is an error, the gate will be opened and a correcting signal $NB_1$ generated from a rate of correction control logic circuit will be transmitted through the gate and through the polarity control circuit CW or CCW to thereby generate a clockwise or counterclockwise signal for driving stepper motor 588. The rate of correction control signal $NB_1$ is generated as a function of the load on self-compensating die 5. Self-compensating die 5 includes a stress gauge or "load sensor" located therein to sense the load which is being imposed thereon as a result of the action of the roller assemblies 510 on the wire passing therethrough. This load signal L is fed to a logic circuit for generating a signal representing the ratio of $N_{B1}$ to the pulses $N_c$ being generated by the electric clock referred to in FIG. 14. The data representing the ratio of $N_{B1}$ tp $N_c$ is then fed to a multiplier circuit along with the signals from the electric clock $N_c$ and the resulting $N_{B1}$ signal is fed to the gate. The larger the load L on he load sensor for self-compensating die 5, the smaller will be $N_{B1}$. The smaller the load L, the larger $N_{B1}$. Thus, when the self-compensating die 5 is just starting up, the load will be zero, electronic gauge 5a will naturally measure an error between $d_{1A}$ and the desired diameter $d_1$, and a signal of a relatively larger magnitude will be fed to stepper motor 588. As stepper motor 588 rotates worm 587, thereby effecting an adjustment of the rollers 510 inwardly, the pressure or load on self-compensating die 5 will build up and the pulse rate $N_{B1}$ will accordingly begin to slow down. As one approaches the point where there is no error E between $d_{1a}$ and $d_1$, magnitude of the signal $N_{B1}$ will be relatively smaller because of the increased pressures being sensed by the load sensor. When there is no error E between $d_{1a}$ and $d_1$, the gate will of course close and no signal $N_{B1}$ will be transmitted to motor 588 regardless of the then magnitude of signal $N_{B1}$.

VII. Section C

Referring to FIGS. 5 and 6, the descaler 14 of section C is a mechanical descaler which can be identical to the mechanical descaler 4 of section A. Self-compensating die 15 is identical in construction to self-compensating die 5 and the electronic wire gauge 15a is idential to gauge 5a. The wire coiler 17 is a conventional device which coils wire coming from drive capstan 16 for subsequent packaging and shipping.

Figure 21:
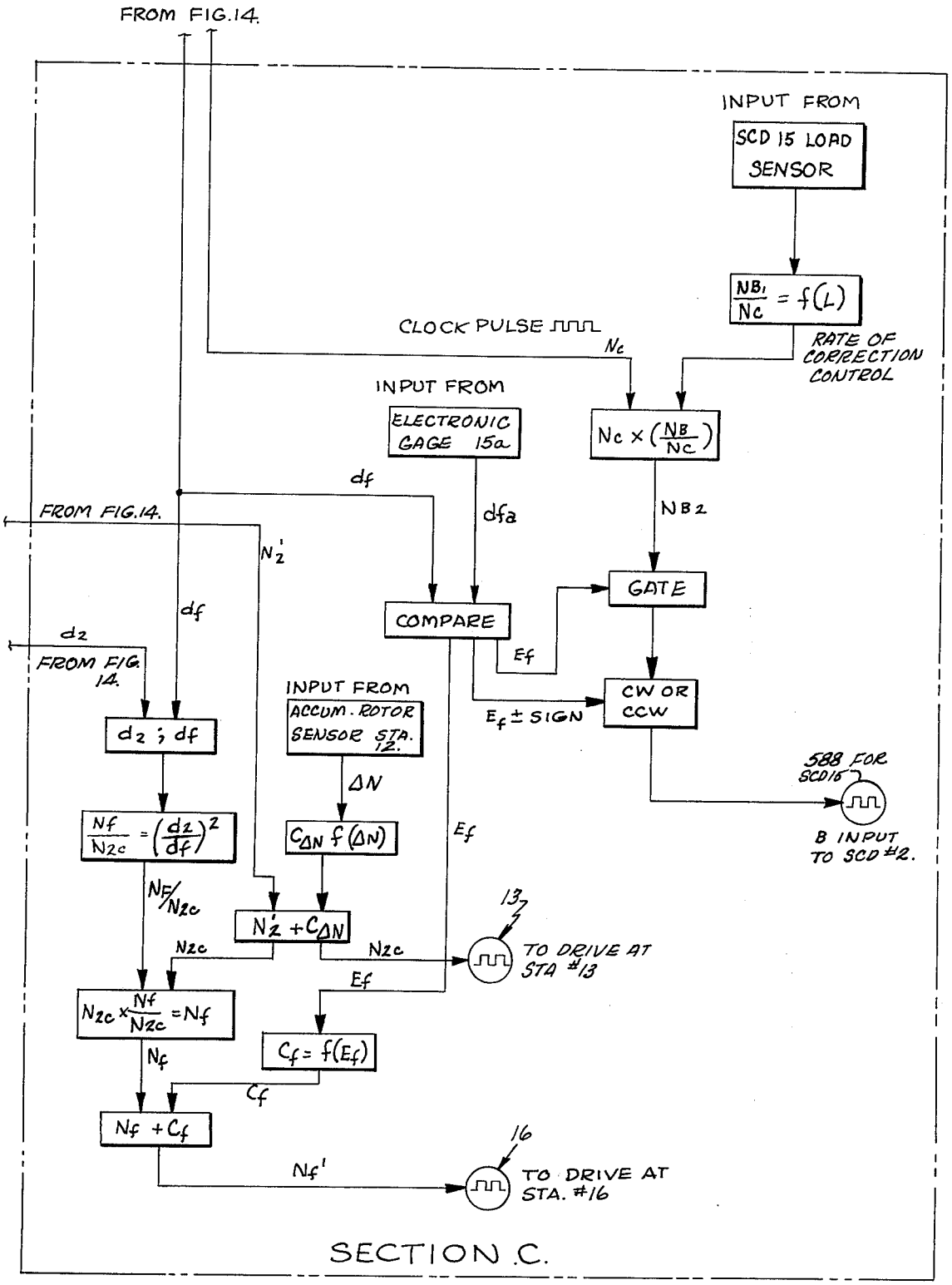
FIG. 21 is a logic diagram for controlling section C of the apparatus.

The control circuit for section C is similar to that for section A and is shown in FIG. 21. The drive for capstan 13 is controlled as a function of the rate of roration of drive capstan 12, i.e., $N_2'$, compensated for based on movement in the accumulator of drive capstan 12. The pulses $N_2'$ generated by the logic circuit shown in FIG. 14 are fed to an addition circuit along with a signal from the accumulator rotor sensor on capstan 12 which generates a signal $\Delta N$ fed to a logic circuit which calculates a correction $C_{\Delta N}$ as a function of $\Delta N$. This $C_{\Delta N}$ for capstan 12 is added to the pulses $N_2'$ to generate a signal $N_{2C}$ for controlling the electro hydraulic stepper motor of drive capstan 13. The signal $N_{2C}$ is also fed to a miltiplier circuit for multiplication by the ratio of $N_f$ to $N_{2C}$ to thereby generate pulses for the rate of rotation of drive capstan 16, $N_f$. The ratio of $N_f$ to $N_{2C}$ is generated as a function of the desired wire diameter $d_2$ as it leaves processing section B and the desired wire diameter $d_f$ as it leaves processing section C. The two signals are generated in the logic circuit of FIG. 14 and are fed into a logic circuit for generating $N_f/N_{2C}$ which is equal to $(d_2/d_f)^2$. The signal $N_f$ generated by the multiplier circuit "$N_{2C}$ times $(N_f/N_{2C})$" is transmitted to an adding circuit which adds a correction factor based on the signal from electric gauge 15a at the end of selfcompensating die 15. The desired final wire diameter $d_f$ is compared with the actual final wire diameter $d_{fa}$ as sensed by electronic gauge 15*a* and the resulting error $E_f$ is fed into a circuit for generating a correction factor $C_f$ as a function of $E_f$. $C_f$ is transmitted to the aforementioned addition circuit and added to $N_f$ and the resulting signal $N_f'$ is transmitted to the electro-hydraulic stepper motor for drive capstan 16.

The error $E_f$ is also used to control stepper motor 588 for self-compensating die 15 with the rate of correction control factor $N_{B2}$ being generated as a function of load as sensed on a load sensor for selfcompensating die 15 in the same manner as the stepper motor 588 for self-compensating die 5 is controlled.

VIII. Operation

To initiate operation of the apparatus, the controller feeds into the data entry of FIG. 14 the initial wire diameter $d_0$, the desired final wire diameter $d_f$, the ultimate tensile strength desired U.T.S., and the carbon content of the wire C%. As a result of this input, temperature control for heating means 8 is generated along with pulse signals $N_1'$ for driving capstan 7 and $N_2'$ for driving capstan 12. In the event that the heating means 8 is operating at maximum power available and higher temperature of the wire W is required, the correction factor $C_1$ will cause capstans 7 and 12 to slow down proportionately, allowing the wire to heat up with the existing maximum heat being inputted by heating means 8. In the event of a serious tension problem building up between capstans 7 and 12, the capstans 7 and 12 will proportionately slow down and even stop momentarily allowing the wire to heat up and relieve the tension, at which time the capstan drives will proportionately smoothly accelerate and proceed again.

The drives in section A and section C follow the drives for capstans 7 and 12, since the rate of operation of section B is critical to controlling the U.T.S. and other physical properties desired. The rate of rotation $N_{1A}$ for capstan 6 is essentially the same as the rate of rotation $N_1'$ for capstan 7 and in fact is controlled based on the pulse signals $N_1'$ used to control capstan 7, with allowance for differences introduced by the accumulator rotor of capstan 6. The accumulator rotor 612 compensates for errors due to lag time and takes care of any cumulative error. The rate of rotation $N_0'$ for drive rollers 210 and straightening rollers 211 and 311 is then generated based on $N_{1A}$, the initial wire diameter $d_0$ and the desired $d_1$ and the actual wire diameter $d_{1a}$ of the wire as it leaves self-compensating die 5.

Similarly, drive capstan 13 is driven based on the signal $N_2'$ generated for driving drive capstan 12 as compensated for by accumulation on accumulation rotor for drive capstan 12. Drive capstan 16 is then driven as a function of the rate of rotation $N_{2C}$ for drive capstan 13 and as a function of the desired diameter of wire $d_2$ leaving processing section B and the desired $d_f$ and final actual diameter wire $d_{fa}$ as it leaves processing section C.

Both sections A and C include circuitry for shifting the sleeve 550 of their respective self-compensating dies with respect to the rotors 520 of their respective self-compensating dies. This signal is generated as a function of the error between $d_1$ and $d_{1a}$ in the case of section A and $d_f$ and $d_{fa}$ in the case of section C, and at a rate which is a function of the load imposed on the respective self-compensating dies 5 and 15 by the action on their roller assemblies 510 against the wire W passing therethrough.

As a result of this apparatus, wire passes through processing sections A, B, and C at rates of from 500 to 2,000 feet per minute. It is pretreated and prereduced in section A, heated to temperatures of approximately 2,000°F by heating means 8 in processing section B, thereafter immediately rapidly quenched by quenching means 9 and fed through a descaler 14 and final self-compensating die 15 in section C and is finally fed into a coiling stand 17. Necking is minimized by the necking control system disclosed in FIGS. 11, 12, and 15. This system gauges the frequency of necks and predetermines the point at which a necking control quenching blast should be directed onto the wire to stop incipient neck formation at the beginning of the quenching chamber 910 of quenching means 9.

The wire achieved as a result of this process has been substantially elongated, as much as 100 and approaching 200 per cent. It is substantially stronger than it was before being treated and tensile strength as great as approaching 200,000 psi have been achieved from wire having an initial tensile strength of only about 77,500 psi. These results are more fully reported hereinbelow.

IX. Experimental Prototype

Considerable experimentation has been conducted on a low spped prototype for the purpose of testing the process and generating the information necessary to store in the computer of the logic circuit of FIG. 14. The construction of the experimental prototype is disclosed in FIGS. 22-26. All of the numbers are preceded by the letter P to indicate that they refer to a prototype.

A. Introduction

Figure 23:
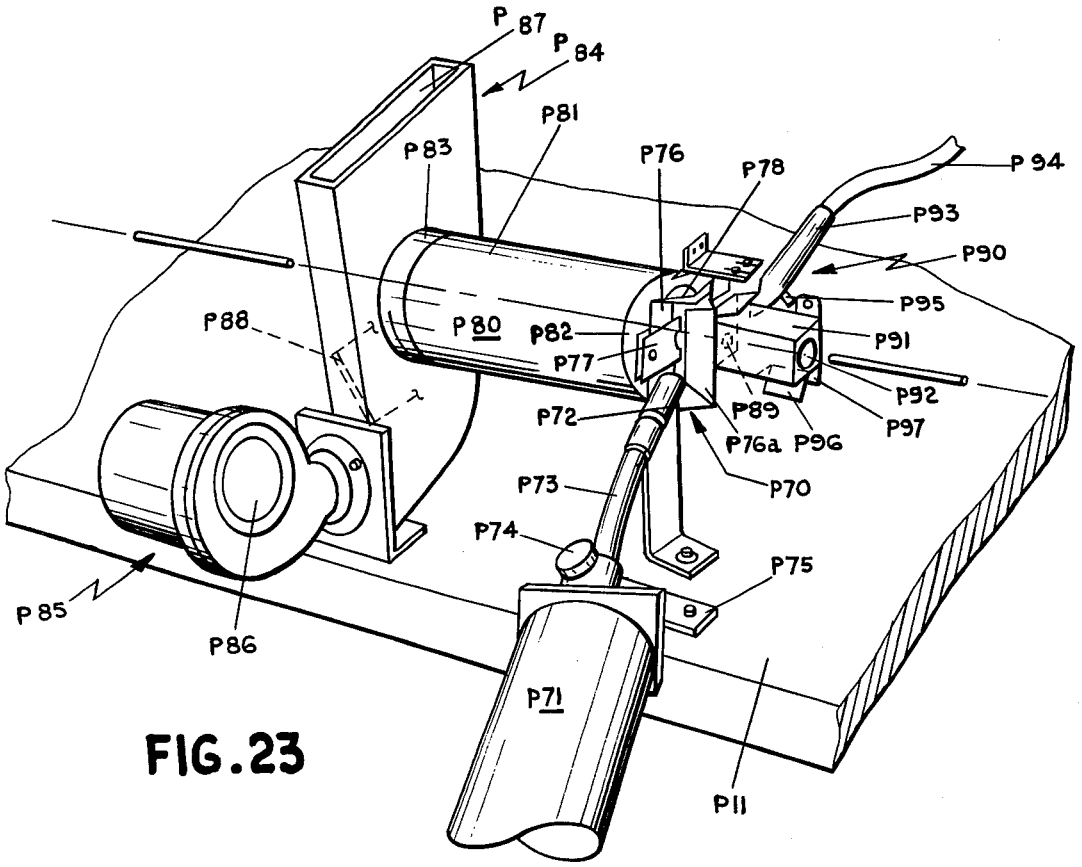
FIG. 23 is a perspective view of the heating and quenching system for the prototype apparatus.
Figure 22:
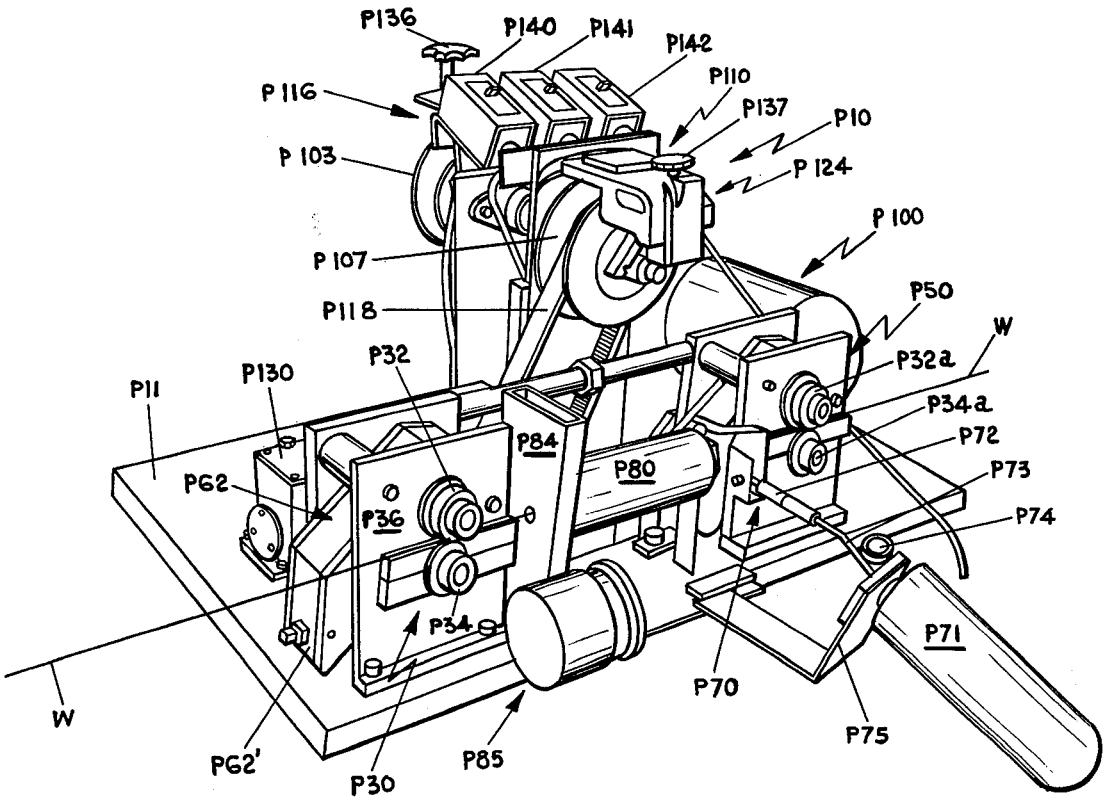
FIG. 22 is a perspective view of a prototype apparatus utilized in testing the method of the present invention.

The prototype of the invention generally designated by the numeral P10 in FIG. 22 includes a supporting framework upon which a pair of spaced-apart force-applying heads P30 and P50 are positioned. For convenience in reference, head P30 will be referred to as te upstream head while head P50 will be referred to as the downstream head, the terms "upstream" and "downstream" being made with reference to the direction of travel of a wire W passing through the apparatus. A heat source P70 is positioned between the upstream and downstream heads together with a preheating chamber assembly P80 and a cooling means P90 (FIG. 23). Suitable drive means as a motor P100 and speed control mechanisms 110 (FIG. 22) are provided for controlling the rate of travel of wire W and for controlling the force applied between heads P30 and P50 as the wire is elongated with movement through the apparatus of the invention as will be hereinafter described. As a wire W is pulled through preheating chamber P80, it begins to heat up. As it passes through heat source P70, a very intense heat is applied to it so that its temperature increases still farther to in excess of the austenite conversion point for the wire thereby causing the yield point of the wire to drop below the level of the stress which is being applied to the wire by the differentially operating force applying heads P30 and P50. This causes the wire to elongate in this localized zone of high heating created by heat source P70. Immediately after the wire passes through heat source P70, however, it is cooled off by cooling means P90 so that the yield point again goes above the level of the stress being applied to the wire so that elongation of the wire will occur only in the very localized heating zone at high heat source P70 as the wire W momentarily passes therethrough.

B. The Zone of heating Apparatus

Referring to FIG. 23, heat source P70 positioned between the upstream and downstream head assemblies P30 and P50 includes a supply source for heat as, for example, a propane tank P71 adapted to direct a flame through a nozzle P72 onto the wire. Heat source P70 is designed to apply a very high level of heat to a very localized segment of wire. The temperature of the wire at that point must be sufficiently high that the yield point of the wire at that point drops below the level of the stress being applied by force applying heads P30 and P50. The nozzle P72 is connected by a conventional conduit P73 to source P71 and a valve P74 is provided to control the flow of the pressurized gas to the nozzle. A bracket P75 holds the nozzle assembly such that the flame therefrom is directed by a funnel shaped baffle assembly P76 at a preferred localized zone of the wire passing between upstream and downstream heads P30 and P50. Baffle P76 includes a sliding plate P77 having an annular recess at one end thereof which is positioned closely adjacent the wire passing therethrough. An observation window P78 is provided above baffle assembly P76 so that temperature can be determined with an optical pyrometer. The right half P76*a* of baffle assembly P76 is slideably adjustable so as to provide a means for adjusting the flow of heat onto the wire.

The preheating chamber assembly P80 is positioned upstream of the wire and adjacent the localized heating zone and serves to gradually increase the temperature of wire W as it approaches heat source P70. It is so designed, however, as to not heat the wire to a yield point below the force being applied to the wire. Preheater P80 includes a tubular insulated chamber P81 having a heat inlet end P82 and an outlet end generally designated by the numeral P83. A chimney assembly P84 is positioned at the heat outlet end and includes a blower P85. Air is drawn in through air inlet P86 at blower P85 and is forced through the chimney P84 upwardly where it is discharged at an outlet P87 formed at the top. An adjustment baffle P88 is positioned within the chimney assembly to control the amount of air forced therethrough. The blower creates an updraft at the outlet end of the preheating chamber P81 and serves to both draw the air therethrough to preheat the wire and additionally prevents excessive heat from being applied to the upstream head P30 during operation.

Cooling means P90 is positioned downstream of the heating zone P70 between the heating zone and downstream heat assembly P50, and is designed to immediately cool the wire as it comes out of heat source P70. This creates a very localized controlled zone of high heating which, because the wire is moving, moves along the length of the wire causing elongation at each point it passes. Because the zone of heating and wire move relative to one another, wire is heated just long enough to facilitate elongation but not long enough to allow the wire to break or generate undesired irregularities in cross-section along the length of the wire after it has been cooled.

Cooling means P90 includes a plenum chamber P91 having an inlet P89 and an outlet opening P92 to allow passage of the wire. The inlet P89 is the beginning of the cooling zone. A nozzle P93 is connected to an air supply through suitable conduit P94 and to a water supply via conduit P95. An opening P96 is formed at the bottom of the plenum chamber P91 to allow cooling air and/or water to pass therefrom. The cooling plenum chamber P91 is secured to the supporting framework 11 by bracket P97.

C. The Force Applying Heads

Figure 25:
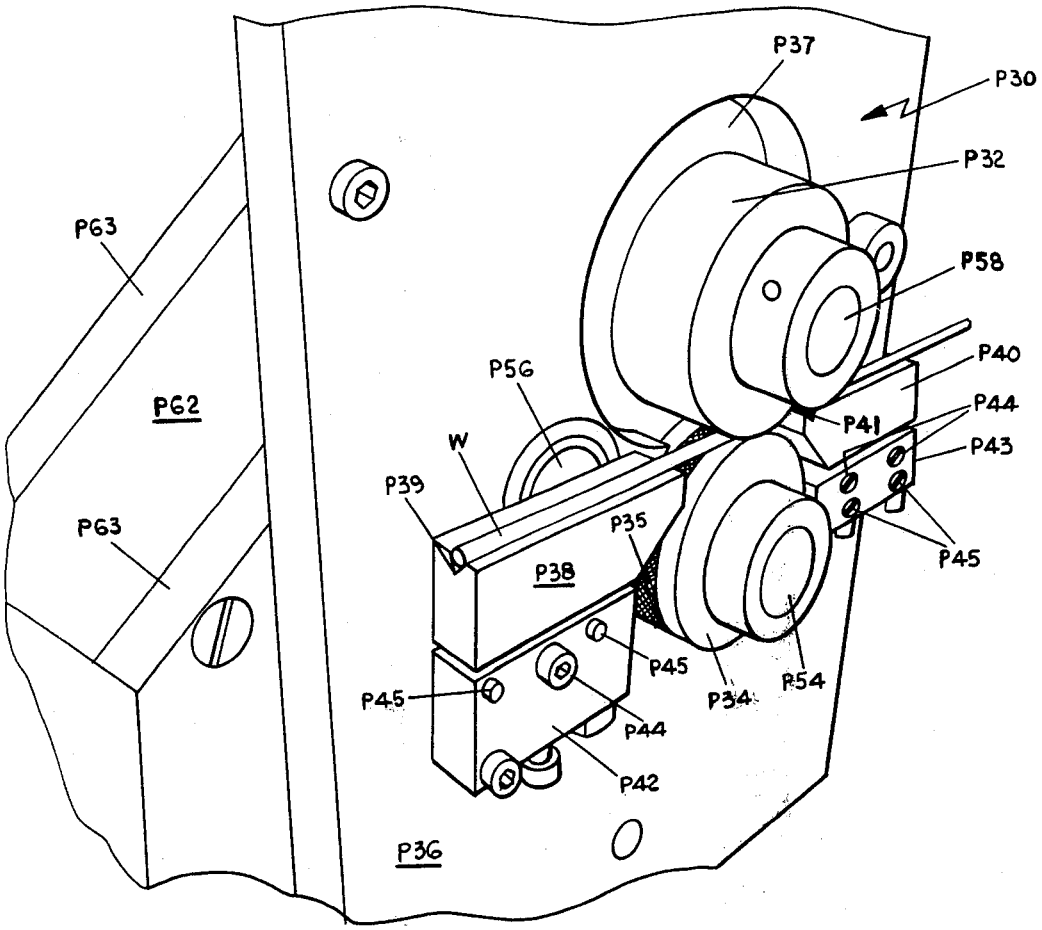
FIG. 25 is a generally perspective view of a set of drive rollers for the prototype apparatus.
Figure 26:
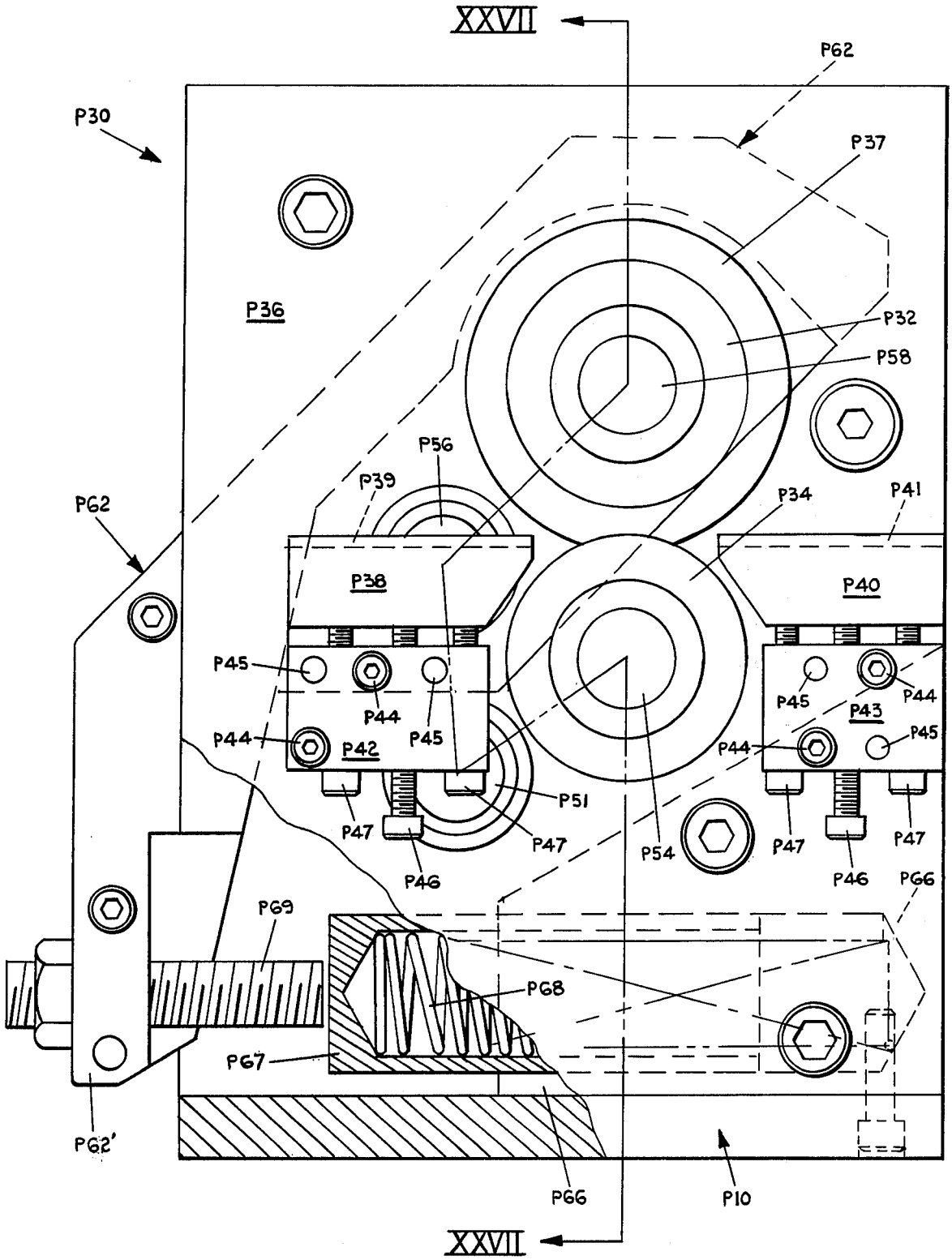
FIG. 26 is a partially cross-sectional front elevational view of the drive rollers shown in FIG. 25.

As shown in FIGS. 22, 25 and 26, upstream head P30 and downstream head P50 are identical in construction and therefore only one head assembly (the upstream head P30) will be described in detail. For purposes of clarity, or when distinctions must be made, downstream head P50 will bear the same reference numeral followed by the suffix letter *a*.

The head assembly includes a pivotally mounted upper roller P32 and a fixed rotatable lower roller P34 mounted outwardly with respect to a face panel P36. Lower roller P34 has a knurled surface P35 to engage a wire positioned between rollers P32 and P34. An opening P37 is provided in panel P36 for passage of the driving and supporting mechanisms for upper pivotally mounted roller P32 (FIG. 25). A pair of guide blocks P38 and P40 are positioned on either side of rollers P32 and P34. A first guide block P38 located on the left includes a V-groove P39 to support a wire W. On the opposite side of rollers P32 and P34 guide block P40 is positioned also having a V-groove P41 provided therein. Support blocks P42 and P43 are mounted on the face panel directly below guide blocks P38 and P40, respectively. Support blocks P42 and P43 are secured to the face panel by means of screws P44 and dowels P45 in a conventional manner. Vertical adjustment screws P46 threadably received in support blocks P42 and P43 extend upwardly and bear against a lower surface of guide blocks P38 and P40. Locking screws P47 which pass through support blocks P42 and P43 on either side of each adjustment screw P46 are threadably received in the guide blocks, when tightened, secure the guide blocks with respect to the supporting blocks by tightening the guide blocks down against the top of adjustment screw P46 (FIG. 26).

Figure 27:
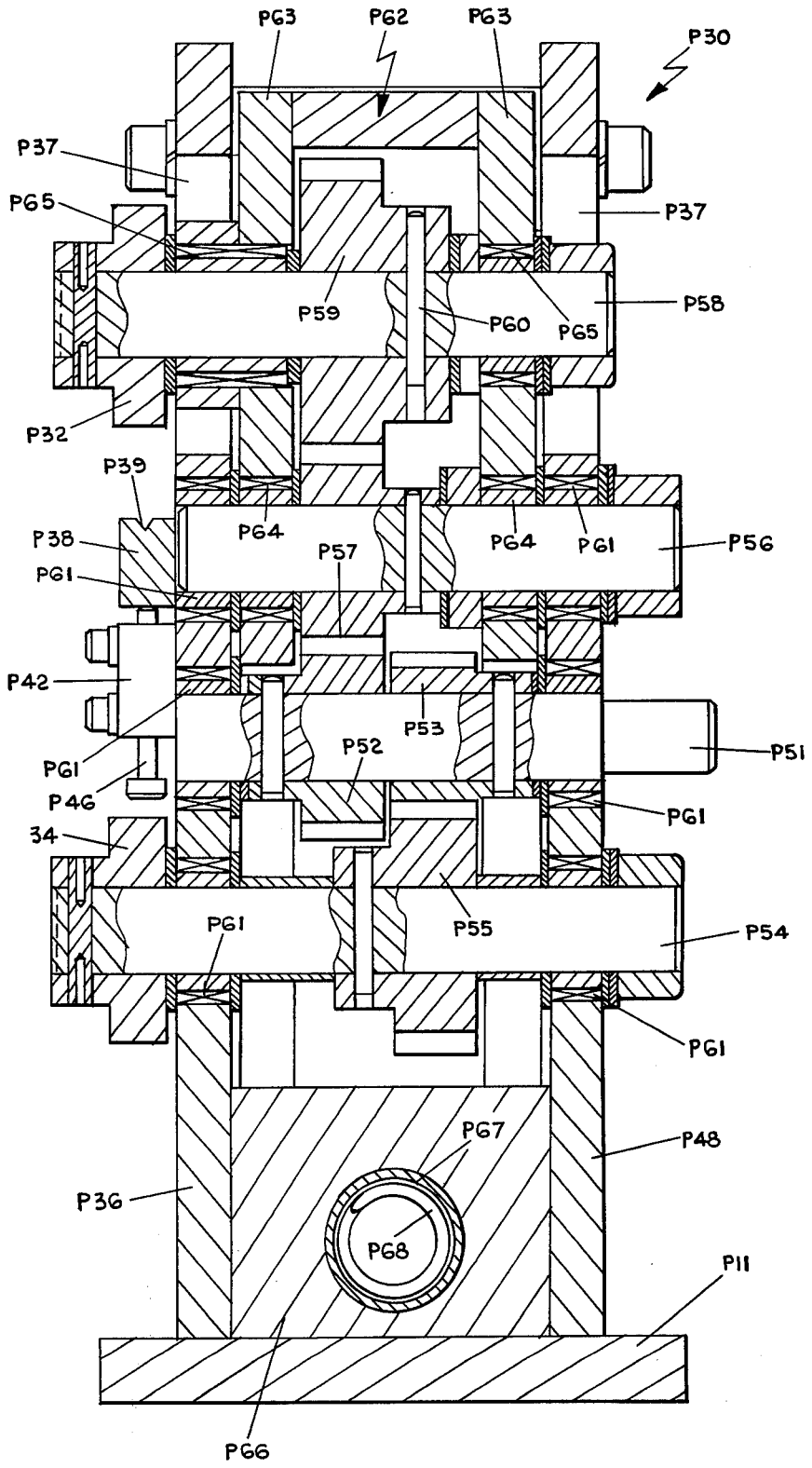
FIG. 27 is a cross-sectional view taken along plane XXVII—XXVII of FIG. 26.

As shown in greater detail in the cross-sectional view of FIG. 27, the head assembly includes not only the front face panel P36 but in addition a spaced back plate P48 forming an enclosure containing bearing means to support the drive mechanisms for rotating the upper and lower roller assemblies. Basically, an input shaft P51 extending outwardly from back plate P48 carries a pair of gears P52 and P53 which are fixed to the shaft as by pins. Gear P53 engages a gear P55 secured on a lower output shaft P54. Output shaft P54 is mounted in bearings P61 and drives lower roller P34 which is also pinned to shaft P54. Gear P52 fixed on input shaft P51 engages an idler gear P57 fixed on an idler shaft P56 also suitably mounted in bearings P61. Idler gear P57 meshes with an upper output gear P59 fixed on an upper output shaft P58. Output shaft P58 in turn is fixed to and drives upper roller P32 in a cooperating direction and at the same rate as lower roller P34. The gears are each fixed with respect to their associated shaft by means of dowel pin P60.

Input shaft P51, lower output shaft P54, and idler shaft P56 are mounted in bearings P61 positioned in front and rear plates P36 and P48, respectively. To allow pivotal movement of upper roller P32 with respect to lower roller P34, openings P37 are provided in the front and rear plates and upper output shaft P58 is mounted for pivotal movement in a pivot arm assembly P62 (FIGS. 26 and 27). Pivot arm assembly P62 includes a pair of side plates P63 in which bearings P64 and P65 mount idler gear shaft P56 and upper output shaft P58 respectively. Idler shaft P56 serves also as a pivot means for pivot arm P62 such that gear P59 can be rotated about gear P57 to thereby attain upward and downward movement of upper roller P32 with respect to roller P34. Referring to FIG. 26, pivot arm assembly 62 includes a downwardly extending arm P62' which carries a tension-adjustment screw P69. A lower spacer block P66 positioned at the lower righthand corner of the head assembly between front and back plates P36 and P48 has an opening provided therein in which a sleeve P67 is slideably mounted. A bias spring P68 within sleeve P67 and the opening in block P66 biases sleeve P67 outwardly into abutment with adjustment screw P69. Spring P68 exerts a biasing force against screw P69 which in turn causes the force applied to arm P62' and pivot arm P62 to pivot about idler shaft P56 thereby urging upper roller P32 toward lower roller P34. Accordingly, a wire resting in the V-grooves P39 and P41 on guide blocks P38 and P40 is frictionally engaged between rollers P32 and P34 for movement thereby.

D. The Driving Mechanism

Figure 24:
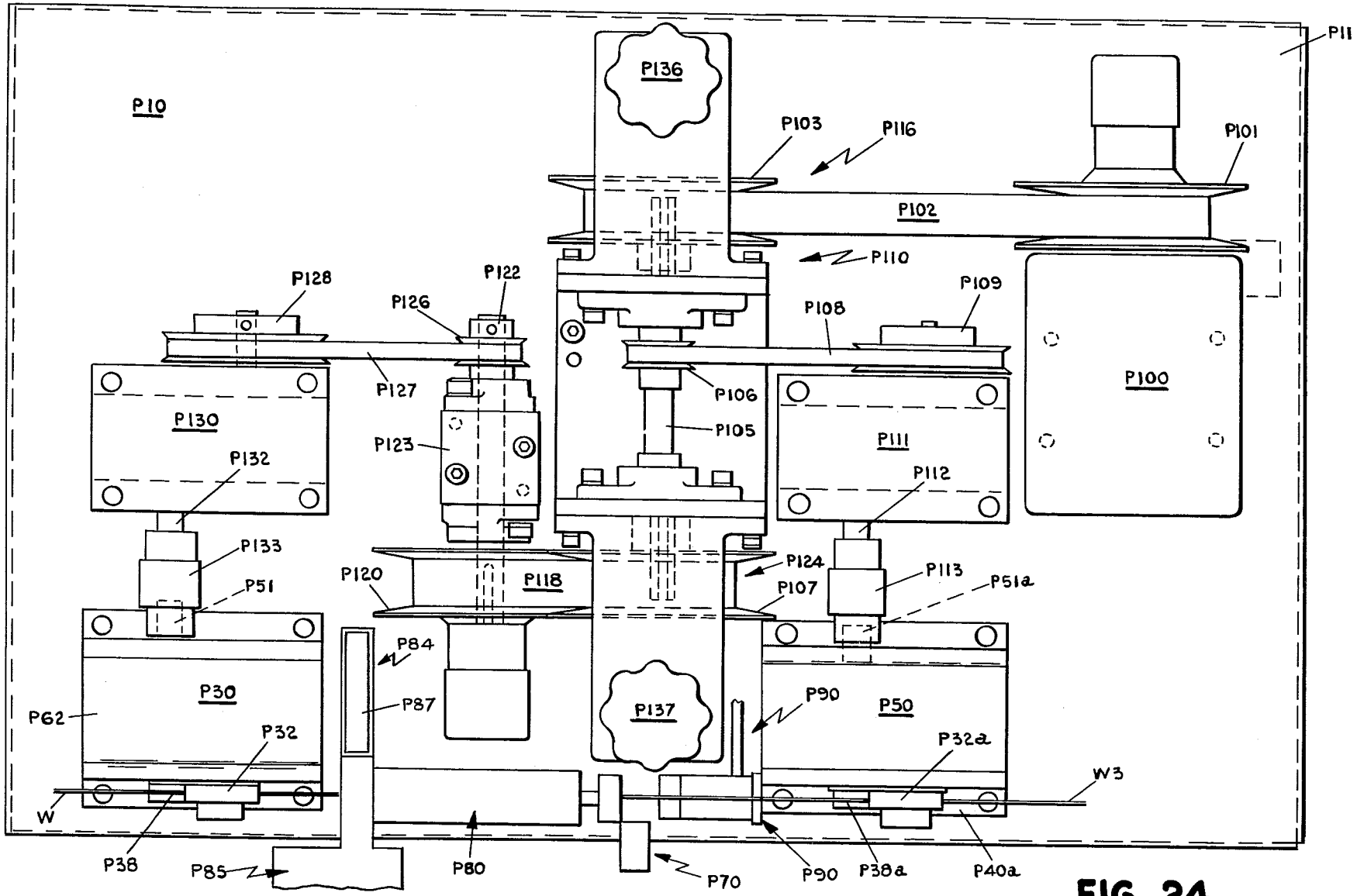
FIG. 24 is a top plan view of the prototype apparatus.

THe driving mechamism for the apparatus are best illustrated in FIG. 24 wherein drive motor P100 is connected to a series of belts, pulleys and speed control mechanisms to drive output shafts P51 on upstream head P30 and P51*a* on downstream head P50. More specifically, drive motor P100 has a pulley P101 connected to its output shaft. A belt P102 driven by pulley P101 transmits the rotation thereof to an adjustable pulley P103 on the primary speed control P116. Pulley P103 in turn dirves a shaft P105 upon which a first small diameter pulley P106 and an adjustable pulley P107 are fixed. Pulley P107, as will be hereinafter descirbed, forms a part of a secondary speed control through belt P108 and a pulley P109. The gear reducer operates in a conventional manner and its output shaft P112 is connected through a coupling P113 to input shaft P51a of downstream head assembly P50.

Adjustable pulley P107 forming part of the secondary speed control P124 is connected through a belt P118 to a pulley P120 mounted on a shaft P122 supported in a bearing block P123. Pulley P120, its associated shaft P122 and a pulley P126 rotatable with shaft P122 serve as an idler assembly to facilitate connection of the outpt of secondary speed control P124 with the input of reducer P130. Pulley P126 driven by shaft P122 is connected by a belt P127 to drive an input shaft and pulley P128 of gear reducer P130. Output shaft P132 of gear reducer P130 is connected through a coupling P133 to input shaft P51 of upstream head assembly P30.

The primary speed control P116, secondary speed control P124 and gear reducers P111 and P130 are conventional components and will therefore not be described in greater detail. Pulleys P103 and P107 are split pulleys with sloped belt engaging walls. Basically, the speed control operates to move the side members of pulleys P103 and P107 toward or away from each other to thereby vary the effective diameter of the pulleys to thereby vary the speed of rotation of the components driven by the belts associated therewith.

The primary speed control P116, utilizing split pulley P103, serves to simultaneously control the speed of the upstream and downstream head assemblies P30 and P50 since pulley P103 controls the input to both. Secondary speed control P124, employing split pulley P107, is used to adjust the relative speed of rotation of the upstream and downstream head assemblies with respect to each other by either increasing or decreasing the rotation of the upstream head assembly P30. Split pulley P107 is positioned so as to control only the input to head assembly P30. Speed adjustments are made in the conventional manner by rotation of the hand wheels P136 and P137 associated with the primary P116 and secondary speed controls P124 respectively.

It will be appreciated by those skilled in the art that the drive arrangement herein described can be reversed so that downstream roller head assembly P50 is the assembly which is individually adjustable, rather than roller head assembly P30. Another way of looking at it is that one could reverse the relative positions of preheating chamber P80, heat source P70 and cooling chamber P90 so that in the arrangement shown in FIG. 24, roller head assembly P30 is the downstream head and roller head assembly P50 is the upstream head. Such an arrangement does, in fact, have the advantage that the input of wire in terms of poundage is constant regardless of the amount of elongation which is effected by varying the relative rate of rotation of the rollers of roller head assembly P30. In fact, recent experimentation reveals that the latter is a preferable arrangement in that better elongation results appear obtainable with such arrangement.

E. Controls

A switch block including switches 140 controlling the motor P100, P141 controlling blower assembly P85, and P 142 controlling an air compressor or other suitable source of air (not shown) connected to conduit P94 and and nozzle P93, is conveniently located at the uppermost portion of the apparatus (FIG. 22).

X. Experimental Results

Figure 28:
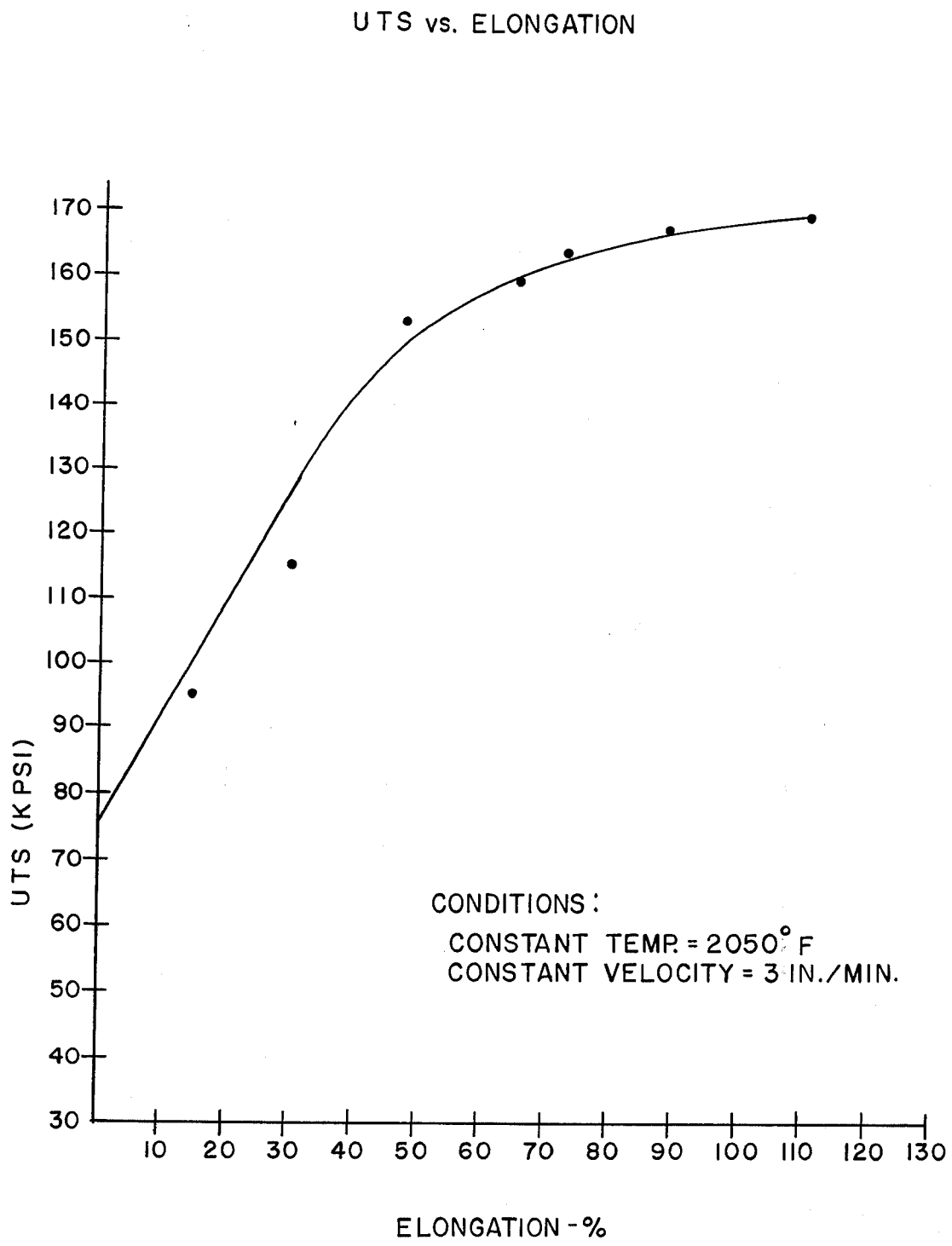
FIG. 28 is a chart of experimental results in which ultimate tensile strength is plotted against percent elongation.

Some of the experimental results achieved with the experimental prototype P10 described above are displayed in FIGS. 28–30, and in Table I below. In FIG. 28, a series of tests were run utilizing a constant temperature of about 2,050°F and utilizing a constant velocity of wire being fed into the machine at 3 inches per minute. The ultimate tensile strength attained in the wire is reflected in the ordinate and is plotted against elongation in terms of per cent on the abscissa. It will be noted that the ultimate tensile strength obtained from wire having an initial tensile strength of only about 77,000 increases sharply as one increase the percentage of elongation and is continuing to incline upwardly at the final point on the graph, i.e., 110 per cent elongation. The tensile strength achieved at 110 per cent elongation was almost 170,000 psi. The carbon content of the wire run in these tests was 0.23%. The wire diameter was 0.227 inches.

Figure 29:
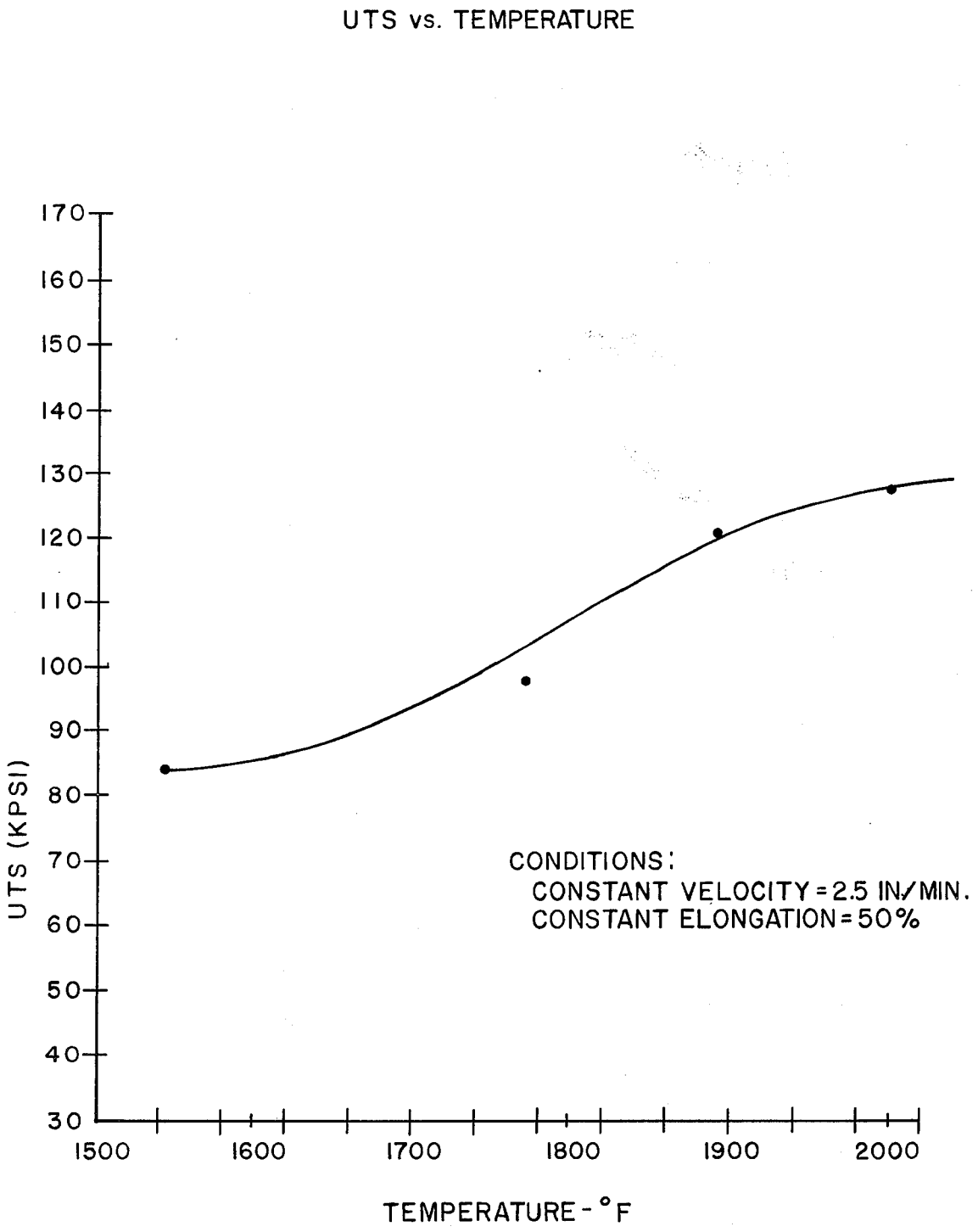
FIG. 29 is a chart of experimental results in which ultimate tensile strength is plotted against variations in temperature of operation.

Referring to FIG. 29, the temperature in degrees Fahrenheit was varied on a number of diffeerent runs while the velocity of wire into the machine was maintained constant at 2.5 inches per minute and the per cent elongation was maintained at a constant 50 per cent for each test specimen. The carbon content of the test specimens used in this test was 0.23%. The wire diameter was 0.227 inches. It can be seen that the temperatures to which the wire was heated start slightly above the austenite conversion temperature for wire having that carbon content and go up. It can be seen that the best results are attained at temperatures of around 2,000°F. The ultimate tensile strength achieved at that temperature was about 127,000 psi. The starting tensile strength for this wire was about 77,000 psi. It can be seen that at 1,550°F a temperature just slightly above the austenite conversion temperature of 1470°F for this carbon steel, the increase in tensile strength was only about 7,000 psi.

Figure 30:
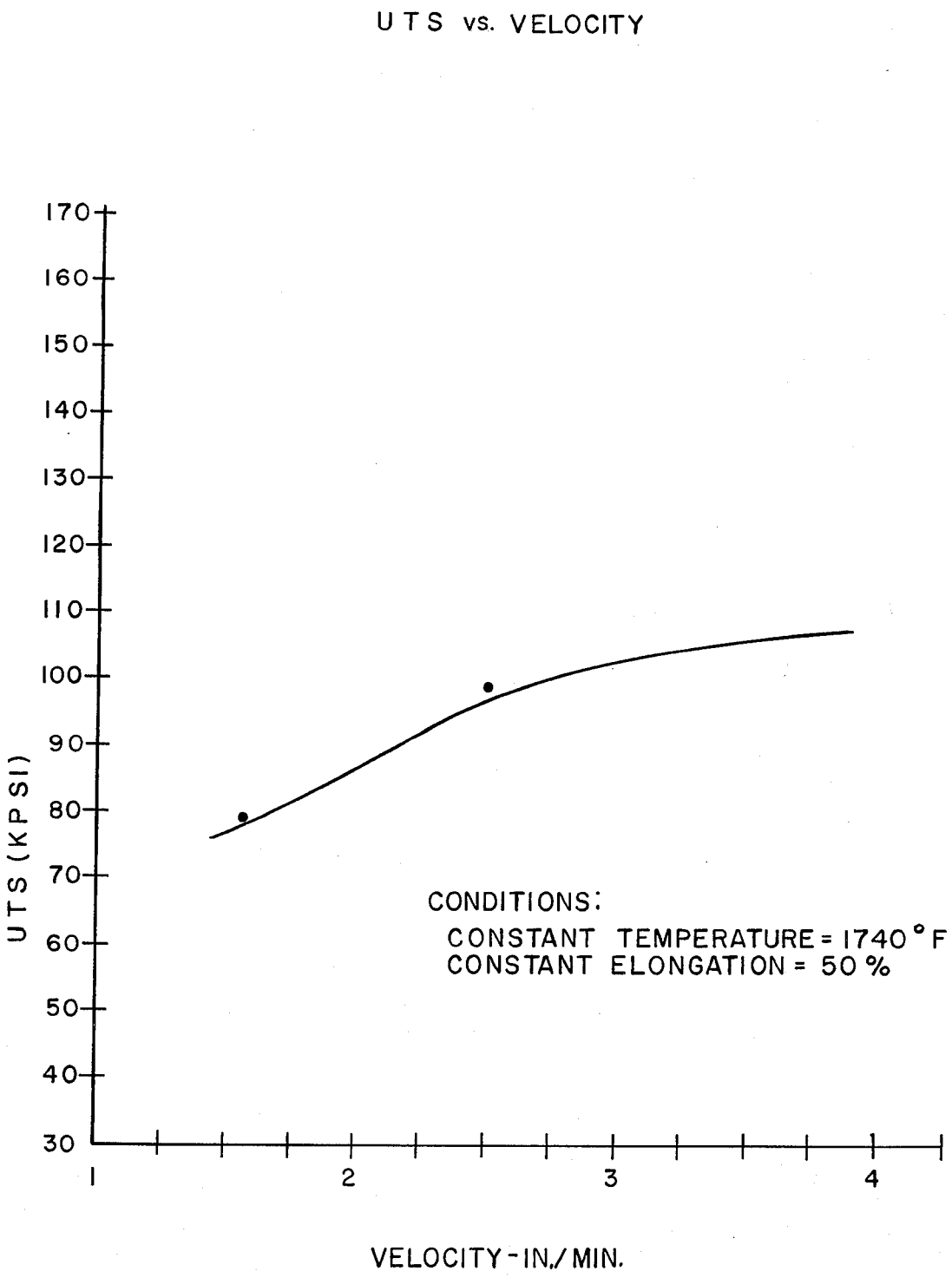
FIG. 30 is a chart of experimental results in which ultimate tensile strength is plotted against the velocity of wire through the apparatus.

Referring to FIG. 30, temperature was maintained constant at 1740°F and elongation was maintained constant at 50 per cent. The wire carbon content was 0.23% and the wire diameter was 0.227 inches. The velocity of wire being fed into the prototype was varied for different runs. It can be seen that at a very slow one-half inch per minute, the increase in ultimate tensile strength from the initial 77,000 is only very, very slight. However, at four inches per minute, the increase from 77,000 is almost 30,000 to 107,000 psi.

Table I displays additional test data in table form. It can be seen that the best results of the Table I tests were obtained with a combination of a high temperature in degrees Fahrenheit and a high percentage elongation. At 187% elongation, a temperature of 1,950° F and a velocity of wire feed at 3.7 inches per minute, a final ultimate tensile strength from 194,000 psi was obtained from wire having an initial psi of only 77,500. All of the wire tested in FIGS. 28–31 were of a low carbon variety having carbon content of 0.23 per cent.

TABLE I

| Orig. Dia. Inches | Final Dia. Inches | Velocity in/min. | Elong. % (Actual) | Temp. °F | Orig. UTS (PSI) | Final UTS (PSI) |
|---|---|---|---|---|---|---|
| .227 | .227 | | 0 | | 77,500 | Control |
| .227 | .151 | 2.8 | 126 | 2080 | 77,500 | 170,400 |
| .227 | .148 | 2.8 | 135 | 2090 | 77,500 | 160,500 |
| .227 | .134 | 2.8 | 190 | 2100 | 77,500 | 169,900 |
| .227 | .132 | 3.3 | 195 | 2100 | 77,500 | 183,800 |
| .227 | .140 | 3.5 | 163 | 2030 | 77,500 | 181,800 |
| .227 | .134 | 3.7 | 187 | 1950 | 77,500 | 194,000 |
| .227 | .227 | | | | 80,900 | Control |
| .227 | .166 | 2.8 | 87 | 2100 | 80,900 | 158,600 |
| .227 | .151 | 2.8 | 126 | 2060 | 80,900 | 168,700 |
| .227 | .147 | 2.8 | 138 | 2000 | 80,900 | 172,400 |
| .227 | .149 | 2.8 | 132 | 1990 | 80,900 | 169,800 |
| .227 | .142 | 2.8 | 155 | 1990 | 80,900 | 165,200 |
| .227 | .227 | | | | 77,800 | Control |
| .227 | .160 | 2.8 | 101 | 2000 | 77,800 | 162,200 |
| .227 | .149 | 2.8 | 132 | 2010 | 77,800 | 164,100 |
| .227 | .142 | 2.8 | 155 | 1980 | 77,800 | 161,400 |
| .227 | .144 | 2.8 | 148 | 1980 | 77,800 | 160,100 |
| .227 | .142 | 2.8 | 155 | 1950 | 77,800 | 150,900 |
| .227 | .151 | 2.8 | 126 | 1930 | 77,800 | 151,400 |

XI. Conclusion

It will be appreciated by those skilled in the art that the process of the present invention results in wire havinb a surprisingly high ultimate tensile strength. Low carbon content wire having diameters of around a quarterinch have been treated and have experienced increases in tensile strength from 77,500 psi to as much as 194,000 psi.

Further, these results can be achieved in a completely automated wire operation which, starting with one or at most a few different diameter green stock rod or wire can take that rod or wire from a low tensile strength and large diameter to a finally desired smaller diameter wire and at a desired tensile strength and a relatively high tensile strength, all automatically. Of course, it will be appreciated that the above is merely a preferred embodiment of the invention and that various changes and alterations can be made without departing from the spirit and broader aspects of the invention.

The embodiments of the invention in which an exclusive property or privilege is claimed are defined as follows:

1. A method for substantially increasing the tensile strength of steel material comprising: moving the steel material relative to adjacent heating and quenching means; heating the steel material at said heating means to a temperature above the austenite conversion temperature for the particular steel material being treated and immediately thereafter rapidly quenching the steel material at the quenching means; simultaneously subjecting the steel material to an external force between two spaced points located on opposite sides of said heating and quenching means to effect elongation and cross section reduction in the steel material between said two spaced points.

2. The method of claim 1 in which said heating step comprises: heating said material to a temperature of at least approximately 2000°F.

3. The method of claim 2 in which said step of elongating said steel material comprises: elongating said steel material by at least 10%.

4. The method of claim 2 in which said step of elongating said steel material comprises: elongating said steel material by at least 50%.

5. The method of claim 2 in which said step of elongating said steel material comprises: elongating said steel material by at least 100%.

6. The method of claim 2 in which said step of elongating said steel material comprises: elongating said steel material by at least an amount approaching 200%.

7. The method of claim 2 in which said steel material comprises steel wire.

8. The method of claim 1 in which said step of elongating said steel material comprises: elongating said steel material by at least 10%.

9. The method of claim 1 in which said step of elongating said steel material comprises: elongating said steel material by at least 50%.

10. The method of claim 9 in which said steel material comprises steel wire.

11. The method of claim 1 in which said step of elongating said steel material comprises: elongating said steel material by at least 100%.

12. The method of claim 1 in which said step of elongating said steel material comprises: elongating said steel material by at least an amount approaching 200%.

13. The method of claim 1 in which said steel material comprises steel wire.

14. The method of claim 1 comprising: locating any incipiently forming necks forming in the steel material in the vicinity of the juncture of said heat and quench means and applying at the quenching means a concentrated quench to the incipient neck so located so as to inhibit its further formation.

15. The method of claim 14 in which said step of locating the incipient neck in the vicinity of the junction of said heating and quenching means comprises: sensing the distance between successive necks previously formed and using the distance so determined to predict the position of the incipient neck.

16. The method of claim 15 in which the distance between said successive previously formed necks is multiplied by a function of the reduction ratio for the steel material from its thickness ahead of said heating and quenching means to its thickness downstream of said heating and quenching means so as to compensate for the fact that the material is in the process of reducing and changing length at the point where the incipient neck is forming.

17. The method of claim 15 in which said steel material is moved by first and second drives on opposite sides of said heating and quenching means, said first and second drives operating at a rate of $N_1'$ and $N_2'$ respectively; providing a blaster nozzle means in said quench means for effecting incipient neck control; using stepper motors to drive said first and second drive means; using an electronic gauge to locate a neck and activate a counter to register the pulses $P_1$ emitted by an electronic clock from the detection of said neck until the detection of the next adjacent neck; using a multiplier circuit to multiply the length of steel material L passing over said second drive means in a given digital drive pulse to said stepper motor for said second drive by a function of the desired drive ratio ($N_2/N_1$) of said second to first drive means; using a divider circuit to divide the distance $S_2$ between said electronic gauge and said blaster nozzle means by the output of said multiplier circuit [$L \times F\ N_2/N_1$)] to yield an output $P_2 = S_2 \div [L \times F\ (N_2/N_1)]$; using a subtracting circuit to subtract $P_2$ from $P_1$ to yield $P_3$; using $P_3$ to activate a counter which is reset pursuant to a signal from said electronic gauge indicating that a neck has been located and using said counter to activate a ramp generator which in turn activates a valve control to begin increasing the flow of quenching fluid to said blaster nozzle means; controlling the extent of flow to said blaster nozzle by using a comparator circuit to compare the size of a neck as gauged by said electronic gauge with the average material thickness as determined by inputting readings from said electronic gauge into an averaging circuit, which averaging circuit ignores necks, and increasing said flow as a function of the deviation of said neck size from said average.

18. The method of claim 14 in which said step of applying a concentrated quench to said incipient neck comprises: providing said quenching means with two spray manifolds for spraying quenching fluid onto the steel material, one of said manifolds comprising a primary quenching manifold and the other comprising a neck inhibiting quenching manifold for delivering a concentrated blast of quenching liquid to the steel material; said step further comprises providing means for diverting the flow of quenching fluid from said primary quenching manifold to said neck inhibiting quenching manifold at such time as the incipient neck is in position adjacent said neck inhibiting quenching manifold.

19. The method of claim 18 in which the size of a previously formed neck, formed a relatively short distance from the incipiently forming neck, is determined and said step of diverting quenching liquid is performed to an extent proportionate to the extent to which said previously formed neck deviates from the normally desired thickness of the steel material.

20. The method of claim 18 in which the size of a previously formed neck, formed a relatively short distance from the incipiently forming neck, is determined and said step of applying a concentrated quench is performed to an extent proportionate to the extent to which said previously formed neck deviates from the normally desired thickness of the steel material.

21. The method of claim 14 in which said steel material is steel wire.

22. The method of claim 1 comprising: sensing the actual temperature to which said steel material is heated by said heating means controlling the velocity with which said steel material moves relative to said heating and quenching means as a function of the temperature so determined.

23. The method of claim 22 which comprises: making a predetermination as to the temperature to which said steel material should be heated by said heating means and either increasing or decreasing the rate of said heating step in accordance with the difference between the actual temperature of the steel as actually determined and the predetermined desired temperature.

24. The method of claim 23 comprising: decreasing the velocity at which the steel material moves relative to said heating and quenching means in the event the rate of heating of the heating means cannot be adjusted upwardly a sufficient amount to compensate for a difference in the temperature as actually sensed and the predetermined desired temperature whereby the steel material will move more slowly and will thereby be heated to a higher temperature by the heating means.

25. The method of claim 22 in which said steel material comprises steel wire.

26. The method of claim 1 comprising: sensing the actual temperature to which said material is heated by said heating means; making a predetermination as to the temperature to which said steel material should be heated by said heating means and either increasng or decreasing the rate of said heating step in accordance with the difference between the actual temperature of the steel as predetermined and the predetermined desired temperature.

27. The method of claim 1 comprising: sensing the tension between the said two spaced points; making a predetermination as to a tension level which said tension between said two spaced points should not be allowed to exceed; slowing to a stop movement of said wire relative to said heating and quenching means in the event said predetermined tension level is exceeded, but maintaining the existing tension between said two spaced points when said steel material is stopped whereby said heating means will soften said steel material thereby causing said steel material to elongate and relieve said tension; initiating movement of said steel material again after said tension has been so relieved.

28. The method of claim 1 in which said steel material is moved and elongated between said two spaced points by providing a first rotatable drive means located upstream from said heating and quenching means and a second rotatable drive means located downstream from said heating and quenching means, said second rotatable drive means being rotated at a rate of rotation faster than said first rotatable drive means and at a ratio proportionate to the desired reduction ratio for said steel material; said method further including the step of sensing the actual thickness of the steel material after it has passed said quenching means and comparing it to a predetermined desired thickness and adjusting the rate of rotation of said second drive means relative to the rate of rotation of said first drive means as a function of the difference between the thickness as sensed and the thickness desired.

29. The method of claim 28 in which said first and second drive means are controlled as follows: determining the reduction ratio ($d_2/d_1$) desired for the material, the temperature (T°) to which the material must be heated and the velocity (V) at which the material must be moved, said determination being made as a function of the carbon content of the starting steel material and the ultimate tensile strength desired; inputting the velocity (V) into a first logic circuit which establishes the ratio of a desired rate of rotation $N_1$ for said first drive means to the rate $N_c$ at which pulses are emitted from an electronic clock, as a function of (V); inputting the ratio $N_1/N_c$ into an additive circuit which adds correcting factor $C_1$, determined as a function of variation between the desired temperature (T°) and the actual temperature ($T_a$°) sensed by a temperature sensor, and $C_2$, determined as a function of excessive tension between said first and second drive means; said additive circuit yielding a corrected value $(N_1/N_c)'$ for $(N_1/N_c)$; inputting $(N_1/N_c)'$ into a first multiplier circuit for multiplying by $N_c$, the signal emitted by said electronic clock, to yield a pulse signal $N_1'$ for driving said first drive means; inputting said reduction ratio $(d_2/d_1)$ into a second logic circuit for computing $d_1$ and $d_2$ separately as a function of $(d_2/d_1)$, the initial material thickness and the final material thickness; feeding $d_2$ and $d_1$ into a squaring circuit in which the ratio of the drive rate for said second drive means to the drive rate for said first drive means $(N_2/N_1)$ is determined as a function of $(d_1/d_2)^2$; inputting $(N_2/N_1)$ into a correction circuit which adds correction factor $C_3$ thereto, $C_3$ being a function of the difference between the actual final material thickness $d_{2a}$ as determined by a final electronic gauge and the desired final material thickness $d_2$; multiplying the output of said correction circuit $(N_2/N_1)$ by $N_1$, as determined hereinabove, and inputting the result $N_2$ into said second drive means.

30. The method of claim 28 in which said steel material is wire.

31. The method of claim 1 in which a predetermined desired ultimate tensile strength for the steel being treated is selected and the desired reduction ratio for the cross section of the steel material is determined as a function of the desired ultimate tensile strength; said method further including the step of preselecting a desired final material cross section; and prereducing the thickness of said steel material prior to performing said heating and quenching step to a degree sufficient to yield a cross section which will be reduced in said simultaneous heating, quenching and elongating step to approximately the desired final cross section as a result of elongation in accordance with the determined reduction ratio.

32. The method of claim 31 in which said steel material is post-reduced in cross section by an amount approximately equal to the amount of tolerance in a negative direction typically resulting from said heating, quenching and simultaneous elongation step.

33. The method of claim 32 in which said steel material is steel wire.

34. The method of claim 1 in which said steel material is post-reduced in cross section by an amount approximately equal to the amount of tolerance in a negative direction typically resulting from said heating, quenching and simultaneous elongation step.

35. The method of claim 34 in which said steel material is steel wire.

36. A method for elongating and reducing the cross section of a metal material comprising: moving the metal material between two spaced points and through an adjacent heating and quenching means located between said two spaced points; applying an elongating force between said two spaced points; heating said metal to a sufficient temperature that its yield point drops below the level of said applied force whereby said metal material elongates and reduces in cross section as a result of the application of said elongating force; subsequently quenching said metal material in said quenching means; locating any incipiently forming neck forming in the material in the vicinity of the juncture of said heat and quench means and applying at the quenching means a concentrated quench to the incipient neck so located so as to inhibit its further formation.

37. The method of claim 36 in which said step of locating the incipient neck in the vicinity of the junction of said heating and quenching means comprising: sensing the distance between successive necks previously formed and using the distance so determined to predict the position of the incipient neck.

38. The method of claim 37 in which the distance between said successive previously formed necks is multiplied by a function of the reduction ratio for the steel material from its thickness ahead of said heating and quenching means to its thickness downstream of said heating and quenching means so as to compensate for the fact that the material is in the process of reducing and changing length at the point where the incipient neck is forming.

39. The method of claim 37 in which said steel material is moved by first and second drives on opposite sides of said heating and quenching means, said first and second drives operating at a rate of $N_1'$ and $N_2'$ respectively; providing a blaster nozzle means in said quench means for effecting incipient neck control; using stepper motors to drive said first and second drive means; using an electronic gauge to locate a neck and activate a counter to register the pulses $P_1$ emitted by an electronic clock from the detection of said neck until the detection of the next adjacent neck; using a multiplier circuit to multiply the length of steel material L passing over said second drive means in a given digital drive pulse to said stepper motor for said second drive by a function of the desired drive ratio $(N_2/N_1)$ of said second to first drive means; using a divider circuit to divide the distance $S_2$ between said electronic gauge and said blaster nozzle means by the output of said multiplier circuit $[L \times F\ (N_2N_1)]$ to yield an output $P_2 = S_2 \div [L \times F\ (N_2/N_1)]$; using a subtracting circuit to subtract $P_2$ from $P_1$ to yield $P_3$; using $P_3$ to activate a counter which is reset pursuant to a signal from said electronic gauge indicating that a neck has been located and using said counter to activate a ramp generator which in turn activates a valve control to begin increasing the flow of quenching fluid to said blaster nozzle means; controlling the extent of flow to said blaster nozzle by using a comparator circuit to compare the size of a neck as gauged by said electronic gauge with the average material thickness as determined by inputting readings from said electronic gauge into an averaging circuit, which averaging circuit ignores necks, and increasing said flow as a function of the deviation of said neck size from said average.

40. The method of claim 36 in which said step of applying a concentrated quench to said incipient neck comprises: providing said quenching means with two spray manifolds for spraying quenching fluid onto the steel material, one of said manifolds comprising a primary quenching manifold and the other comprising a neck inhibiting quenching manifold for delivering a concentrated blast of quenching liquid to the steel material; said step further comprises providing means for diverting the flow of quenching fluid from said primary quenching manifold to said neck inhibiting quenching manifold at such time as the incipient neck is in position adjacent said neck inhibiting quenching manifold.

41. The method of claim 40 in which the size of a previously formed neck, formed a relatively short distance from the incipiently forming neck, is determined and said step of diverting quenching liquid is performed to an extent proportionate to the extent to which said previously formed neck deviates from the normally desired thickness of the material.

42. The method of claim 40 in which the size of a previously formed neck, formed a relatively short distance from the incipiently forming neck, is determined and said step of applying a concentrated quench is performed to an extent proportionate to the extent to which said previously formed neck deviates from the normally desired thickness of the material.

43. The method of claim 36 in which said metal material is wire.

44. The method of claim 43 in which said wire is steel wire.

45. A method for producing steel material having a particular predetermined desired ultimate tensile strength comprising: moving the steel material relative to adjacent heating and quenching means; heating the material at said heating means to a temperature rendering it plastic; elongating and reducing said material in thickness between two spaced points located on opposite sides of said heating and quenching means thereafter rapidly quenching the material at the quenching means; and controlling the final ultimate tensile strength of the material by adjusting the amount of elongation to effect a particular, predetermined percentage of elongation.

46. The method of claim 45 in which ultimate tensile strength is further controlled by heating the material to a particular predetermined temperature.

47. The method of claim 46 in which ultimate tensile strength is further controlled by moving the material at a particular predetermined velocity.

48. The method of claim 45 in which ultimate tensile strength is further controlled by moving the material at a particular predetermined velocity.

49. A method for producing steel material having a particular predetermined desired ultimate tensile strength comprising: moving the steel material relative to adjacent heating and quenching means; heating the material at said heating means to a temperature rendering it plastic; elongating and reducing said material in thickness between two spaced points located on opposite sides of said heating and quenching means thereafter rapidly quenching the material at the quenching means; and controlling the final ultimate tensile strength of the material by heating the material to a particular predetermined temperature.

50. The method of claim 49 in which ultimate tensile strength is further controlled by moving the material at a particular predetermined velocity.

51. A method for producing steel material having a particular predetermined desired ultimate tensile strength comprising: moving the steel material relative to adjacent heating and quenching means; heating the material at said heating means to a temperature rendering it plastic; elongating and reducing said material in thickness between two spaced points located on opposite sides of said heating and quenching means thereafter rapidly quenching the material at the quenching means; and controlling the final ultimate tensile strength of the material by moving the material at a particular predetermined velocity.

52. The method of claim 51 in which ultimate tensile strength is further controlled by heating the material to a particular temperature.

53. A method for substantially increasing the tensile strength of the steel material comprising:

moving the steel material relative to adjacent heating and quenching means; heating the steel material at said heating means to a temperature above the Austenite conversion temperature for the particular steel material being treated and simultaneously subjecting the steel material to the stress of substantial cross sectional reduction at said heating means while said steel is at a temperature above its Austenite conversion temperature; and thereafter immediately rapidly quenching the steel material at the quenching means.

54. The method of claim 53 in which said heating step comprises: heating said steel material to a temperature of at least approximately 2000°F.

55. The method of claim 54 in which said step of reducing the cross section of said steel material comprises elongating said steel material by at least 10%.

56. The method of claim 54 in which said step of reducing the cross section of said steel material comprises elongating said steel material by at least 50%.

57. The method of claim 54 in which said step of reducing the cross section of said steel material comprises elongating said steel material by at least 100%.

58. The method of claim 54 in which said step of reducing the cross section of said steel material comprises elongating said steel material by at least 200%.

59. The method of claim 54 in which said steel material comprises steel wire.

60. Apparatus for substantially elongating materials comprising: heating means for heating the material to a softened, plastic state; quenching means positioned adjacent said heating means for rapidly quenching the heated material back to a non-plastic state; spaced first and second drive means positioned on opposite sides of said heating and quenching means for moving said material through said heating and quenching means, said second drive means operating at a rate faster than said first drive means whereby said first and second drive means serve to apply an elongating force on said material to effect a substantial elongation thereof; locating means for locating any incipiently forming necks forming in the material in the vicinity of the juncture of said heating and quenching means; and said quenching means including neck inhibiting quenching means for delivering a concentrated quench to said incipient neck to inhibit its further formation.

61. The apparatus of claim 60 in which said locating means comprising neck sensing means positioned at the downstreeam end of said quenching means for sensing necks after they have been formed; and neck locating logic means for predicting the location of incipiently forming necks as a function of the distance between previously formed necks as sensed by said sensing means.

62. The apparatus of claim 61 in which said neck locating logic means includes multiplying means for multiplying the distance between previously formed necks as sensed by said neck sensing means by a function of the extent to which material is reduced in thickness in said apparatus in order to compensate for the fact that the material is in the process of reducing and changing length at the point where the incipient neck is forming.

63. The apparatus of claim 62 in which said quench means including blaster nozzle means and a valve control operably connected to said blaster nozzle means for effecting incipient neck control; stepper motors driving said first and second drive means at a rate of $N_1'$ and $N_2'$ respectively; an electronic clock, a first counter and an electronic gauge operably interconnected such that said electronic gauge locates a neck and activates said counter to register the pulses $P_1$ emitted by said electronic clock from the detection of said neck until the detection of the next adjacent neck; a multiplier circuit to multiply the length of steel material L passing over said second drive means in a given digital drive pulse to said stepper motor for said second drive by a function of the desired drive ratio $(N_2/N_1)$ of said second to first drive means; a divider circuit operably connected to said multiplier circuit to divide the distance $S_2$ between said electronic gauge and said blaster nozzle means by the output of said multiplier circuit $[L \times F(N_2/N_1)]$ to yield an output $P_2 = S_2 \div [L \times F(N_2/N_1)]$; a subtracting circuit operably connected to said divider circuit and said first counter to subtract $P_2$ from $P_1$ to yield $P_3$, said subtracting circuit being operably connected on its output side to a second counter such that $P_3$ is used to activate said second counter, which is reset pursuant to a signal from said electronic gauge indicating that a neck has been located; said second counter being operably connected to a ramp generator which in turn is operably connected to said valve control to begin increasing the flow of quenching fluid to said blaster nozzle means; a comparator circuit for comparing the size of a neck as gauged by said electronic gauge with the average material thickness as determined by inputting readings from said electronic gauge into an averaging circuit, which averaging circuit ignores necks, operably connected to said ramp generator, for increasing said flow as a function of the deviation of said neck size from said average.

64. The apparatus of claim 62 in which said quenching means includes a primary quenching means in addition to said neck inhibiting quenching means; manifold means delivering quenching fluid from a single source to said primary quenching means and said neck inhibiting quenching means; and quenching fluid diverter means operably connected to said manifold means for diverting the flow of quenching liquid between said primary quenching means and said neck inhibiting quenching means when a located incipient neck is in position to be quenched by said neck inhibiting quenching means.

65. The apparatus of claim 64 in which a diverter control logic means operably connects said sensing means with said diverter means for generating a control signal as a function of the size of the deviation of said neck as sensed by said neck sensing means.

66. The apparatus of claim 65 in which said diverter control logic means comprises: said quench means including blaster nozzle means and a valve control operably connected to said blaster nozzle means for effecting incipient neck control; stepper motors driving said first and second drive means at a rate of $N_1'$ and $N_2'$ respectively; an electronic clock, a first counter an a electronic gauge operably interconnected such that said electronic gauge locates a neck and activates said counter to register the pulses $P_1$ emitted by said electronic clock from the detection of said neck until the detection of the next adjacent neck; a multiplier circuit to multiply the length of steel material L passing over said second drive means in a given digital drive pulse to said stepper motor for said second drive by a function of the desired drive ratio $(N_2/N_1)$ of said second to first drive means; a divider circuit operably connected to said multiplier circuit to divide the distance $S_2$ between said electronic gauge and said blaster nozzle means by the output of said multiplier circuit $[L \times F(N_2/N_1)]$ to yield an output $P_2 = S_2 \div [L \times F(N_2/N_1)]$; a subtracting circuit operably connected to said divider circuit and said first counter to subtract $P_2$ from $P_1$ to yield $P_3$, said subtracting circuit being operably connected on its output side to a second counter such that $P_3$ is used to activate said second counter, which is reset pursuant to a signal from said electronic gauge indicating that a neck has been located; said second counter being operably connected to a ramp generator which in turn is operably connected to said valve control to begin increasing the flow of quenching fluid to said blaster nozzle means; a comparator circuit for comparing the size of a neck as gauged by said electronic gauge with the average material thickness as determined by inputting readings from said electronic gauge into an averaging circuit, which averaging circuit ignores necks, operably connected to said ramp generator, for increasing said flow as a function of the deviation of said neck size from said average.

67. The apparatus of claim 60 in which said quenching means includes a primary quenching means in addition to said neck inhibiting quenching means; manifold means delivering quenching fluid from a single source to said primary quenching means and said neck inhibiting quenching means; and quenching fluid diverter means operably connected to said manifold means for diverting the flow of quenching liquid between said primary quenching means and said neck inhibiting quenching means when a located incipient neck is in position to be quenched by said neck inhibiting quenching means.

68. Apparatus for substantially elongating materials comprising: heating means for heating the material to a softened, plastic state; quenching means positioned adjacent said heating means for rapidly quenching the heated material back to its non-plastic state; spaced first and second drive means positioned opposite sides of said heating and quenching means for moving said material through said heating and quenching means, said second drive means operating at a rate faster than said first drive means whereby said first and second drive means serve to apply an elongating force on said material to effect a substantial elongation thereof; digital control means operating said first drive means, said digital control means including: an electronic clock for emitting pulses; a first ratio determining circuit for determining the ratio of the number of pulses per period of time required to drive said first drive means to the number of pulses for the same period of time emitted by said electronic clock, as a function of the velocity at which material is to be processed by said apparatus and for generating a digital signal representative thereof; first multiplier means coupled to said first ratio determining means and coupled to said electronic clock for multiplying the number of pulses emitted by said electronic clock by said digital signal generated by said first ratio determining means for generating a first drive signal emitted for digitally driving said first drive means; a drive ratio circuit for generating a digital drive ratio signal representing the rate of operation of said second drive means to that of said first drive means; second multiplier means coupled to said first multiplier means and coupled to said drive ratio circuit for multiplying said first drive signal by said drive ratio signal for thereby emitting a second drive signal for digitally driving said second drive means.

69. The apparatus of claim 68 including sensing means sensing the actual thickness of material after it has passed said quenching means; comparing means operably connected to said sensing means for comparing the thickness actually sensed to a predetermined desired thickness; and second drive correction circuit coupled to said comparing means and to said second multiplier means for adjusting the second drive signal and thereby the rate of operation of said second drive means relative to the rate of operation of said first drive means as a function of the difference between the thickness sensed and the thickness desired.

70. The apparatus of claim 69 comprising: means for sensing the temperature of said material as it passes through said heating means; control means operably connected to said temperature sensing means and to said heating means for increasing or decreasing the heating rate of said heating means in accordance with the difference between the actual temperature of the material and the predetermined desired temperature.

71. The apparatus of claim 70 comprising: temperature compensating control means operably connected to both said temperature sensing means and to said heating means and to said first and second drive means for decreasing proportionately the rates of operation of said first and second drive means when the actual temperature of said material as sensed by said sensing means is too low and said heating means is operating at its maximum capacity.

72. The apparatus of claim 68 including means sensing the tension between said first and second drive means; tension compensating control means operably connected to said tension sensing means and to said first and second drive means for stopping movement of said first and second drive means when the tension sensed by said tension sensing means reaches a predetermined level and for automatically starting said first and second drive means again when the material has been softened by said heating means to relieve the tension between said first and second drive means.

73. Apparatus for substantially elongating material comprising: heating means for heating the material to a softened, plastic state; quenching means positioned adjacent said heating means for rapidly quenching the heated material back to a non-plastic state; spaced first and second drive means positioned on opposite sides of said heating and quenching means for moving said material to said heating and quenching means, said second drive means operating at a rate faster than said first drive means whereby said first and second drive means serve to apply an elongating force on said material to effect a substantial elongation thereof; adjustable die means positioned upstream of said first drive means for effecting a prereduction of the cross section of the material prior to its passing through said heating means and said quenching means.

74. The apparatus of claim 73 which includes a postreduction die means positioned downstream from said second drive means for effecting a final reduction of the thickness of the material after it has passed through said heating and quenching means.

75. The apparatus in accordance with claim 74 including logic control means comprising: a first logic circuit which establishes the ratio of a desired rate of rotation $N_1$ for said first drive means to the rate $N_c$ at which pulses are emitted from an electronic clock, as a function of velocity (V) at which the material must move; an additive circuit operably connected to said first logic circuit and which adds to the ratio $(N_1/N_c)$ correcting factor $C_1$, determined as a function of variation between the desired temperature (T°) and the actual temperature ($T_a$°) sensed by a temperature sensor and $C_2$, determined as a function of excessive tension between said first and second drive means; said additive circuit yielding a corrected value $(N_1/N_c)'$ for $(N_1/N_c)$; first multiplier circuit operably connected to said additive circuit for multiplying $(N_1/N_c)'$ by $N_c$, the signal emitted by said electronic clock, to yield a pulse signal $N_1'$; the output side of said first multiplier circuit being operably connected to said first drive means for driving said first drive means at $N_1'$; a second logic circuit for computing $d_1$ and $d_2$ separately as a function of the desired reduction ratio $(d_2/d_1)$ for the material, the initial material thickness and the final actual material thickness; a squaring circuit operably connected to said second logic circuit in which the ratio of the drive rate for said second drive means to the drive rate for said first drive means $(N_2/N_1)$ is determined as a function of $(d_1/d_2)^2$; a first correction circuit operably connected to said squaring circuit which adds correction factor $C_3$ to $(N_2/N_1)$ to yield $(N_2/N_1)'$, $C_3$ being a function of the difference between the actual final material thickness $d_{2a}$ as determined by a final electronic gauge and the desired final material thickness $d_2$; a second multiplying circuit operably connected to the output of said correction circuit for multiplying $(N_2/N_1)'$ by $N_1$, as determined hereinabove; and the output side of said second multiplying circuit being operably connected to said second drive means.

* * * * *